US008602515B2

(12) United States Patent
Satoh et al.

(10) Patent No.: US 8,602,515 B2
(45) Date of Patent: Dec. 10, 2013

(54) IMAGE FORMING DEVICE

(75) Inventors: Kaoru Satoh, Kanagawa (JP); Sumiaki Aoki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 84 days.

(21) Appl. No.: 13/402,252

(22) Filed: Feb. 22, 2012

(65) Prior Publication Data

US 2012/0229541 A1 Sep. 13, 2012

(30) Foreign Application Priority Data

Mar. 8, 2011 (JP) ..... 2011-050684

(51) Int. Cl.
*B41J 29/38* (2006.01)

(52) U.S. Cl.
USPC ..... 347/9; 347/11; 347/68

(58) Field of Classification Search
USPC ..... 347/5, 9, 10, 11, 69
See application file for complete search history.

(56) References Cited

U.S. PATENT DOCUMENTS

| | | | | |
|---|---|---|---|---|
| 6,053,596 | A | 4/2000 | Nakano et al. | |
| 6,443,547 | B1 | 9/2002 | Takahashi et al. | |
| 6,923,520 | B2 | 8/2005 | Oikawa et al. | |
| 7,494,199 | B2 | 2/2009 | Aoki | |
| 7,686,408 | B2 * | 3/2010 | Tamura | 347/9 |
| 7,828,402 | B2 | 11/2010 | Otsuka | |
| 8,303,064 | B2 * | 11/2012 | Oshima et al. | 347/9 |

FOREIGN PATENT DOCUMENTS

| | | |
|---|---|---|
| JP | 9-254380 | 9/1997 |
| JP | 10-146970 | 6/1998 |
| JP | 2001-315328 | 11/2001 |
| JP | 2002-36535 | 2/2002 |
| JP | 2002-240281 | 8/2002 |
| JP | 2007-144787 | 6/2007 |
| JP | 2008-254204 | 10/2008 |

* cited by examiner

*Primary Examiner* — Lam S Nguyen
(74) *Attorney, Agent, or Firm* — Cooper & Dunham LLP

(57) ABSTRACT

An image forming device includes a liquid discharge head including piezoelectric elements; a drive waveform generating unit that outputs a drive waveform; a selection unit that applies the drive waveform to the piezoelectric elements; a resonant frequency adjusting circuit that is connected in parallel with the piezoelectric elements; a switch unit that switches the resonant frequency adjusting circuit; and a switching control unit that causes the switch unit to switch in accordance with a first number of simultaneously driven piezoelectric elements. When the first number of the simultaneously driven piezoelectric elements is greater than a predetermined number, the switching control unit connects the resonant frequency adjusting circuit, so that a resonant frequency of a closed loop becomes lower than a resonant frequency of the closed loop when the first number of the simultaneously driven piezoelectric elements is less than the predetermined number.

3 Claims, 19 Drawing Sheets

FIG.18

| NUMBER OF SIMULTANEOUSLY DRIVEN CHANNELS | SW0 | SW1 | SW2 | SW3 | SW4 | SW5 | SW6, 7 | SW8～11 |
|---|---|---|---|---|---|---|---|---|
| 1～2 | × | ○ | × | × | × | × | × | × |
| 3～5 | × | × | ○ | × | × | × | × | × |
| 6～9 | × | × | × | ○ | × | × | × | × |
| 10～20 | × | × | × | × | ○ | × | × | × |
| 21～40 | × | × | × | × | × | ○ | × | × |
| 41～80 | ○ | × | × | × | × | × | × | × |
| 81～160 | ○ | × | × | × | × | × | ○ | × |
| 161～320 | ○ | × | × | × | × | × | × | ○ |

IMAGE FORMING DEVICE

BACKGROUND OF THE INVENTION

1. Field of the Invention

Embodiments of the present invention relate to an image forming device. Specifically, the embodiments relate to an image forming device including a liquid discharge head that utilizes piezoelectric elements for generating pressure.

2. Description of the Related Art

As an image forming device such as a printer, a facsimile machine, a copier, a plotter, or a combined machine thereof, an image forming device (an ink jet recording device) of a liquid discharge recording type that utilizes a recording head including a liquid discharge head (a liquid droplet discharge head) that discharges an ink droplet is known. The image forming device of the liquid discharge recording type forms an image (recording, typing, imaging, and printing are used as synonyms) by discharging ink droplets from the recording head onto a sheet being conveyed. Here, the sheet is not limited to a paper, but including an OHP and the like. The sheet means something to which an ink droplet, or other liquid can be adhered. It may be referred to as a medium to be recorded on, a recording medium, a recording paper, or a recording sheet. There are two types of the image forming devices of the liquid discharge recording type. Namely, one of them is an image forming device of serial type, in which a recording head forms an image when the recording head moves in the main scanning direction while discharging liquid droplets. The other one is an image forming device of line type which utilizes a line-type head.

In the present specification, the image forming device of liquid discharge recording type is a device which forms an image by discharging a liquid onto a medium, such as a paper, a line, a fiber, a fabric, a leather, a metal, a plastic, a glass, a timber, or a seramic. Further, "forming an image" means not only to add an image having a meaning, such as a character or a graphic, to a medium, but also to add an image having no meaning, such as a pattern, to a medium (simply to apply liquid droplets to the medium). Further, "an ink" means not only a usual ink, but is also a generic term of a liquid with which an image can be formed, such as a recording liquid, a fixing liquid, or a fluid. For example, a DNA sample, a resist, a pattern material, and a resin are included in "inks." Further, a material of "a sheet" is not limited to a paper, and "a sheet" means something to which ink droplets adhere, including the above described OHP sheet and fabric. Namely, the term "a sheet" is used as a generic term for referring to something to which ink droplets adhere, such as a medium to be recorded, a recording medium, a recording paper, or a recording sheet. Further, "an image" means not only a two-dimensional image, but also an image attached to something which is formed three-dimensionally and an image which is formed three-dimensionally.

As a liquid discharge head, a so-called "piezoelectric type head" is known. Here, the piezoelectric type head includes a piezoelectric body as a pressure generating means that applies pressure to an ink, that is, for example, a liquid inside a liquid chamber. The piezoelectric type head includes, for example, a piezoelectric actuator in which plural pillar-shaped piezoelectric elements (piezoelectric poles) are formed by grooving a laminated piezoelectric member in which piezoelectric layers and internal electrodes are alternately laminated. Alternatively, for example, the piezoelectric type head includes a piezoelectric actuator in which electrodes are arranged to nip a piezoelectric layer and which is formed of a thin-film piezoelectric material. The piezoelectric type head causes an oscillation plate, which can be elastically deformed and which forms a wall surface in the liquid chamber, to be deformed using the piezoelectric actuator, and causes a volume and pressure inside the liquid chamber to vary, and discharges liquid droplets.

As a drive control circuit for driving and controlling such a piezoelectric type head, the following circuit has been known. Namely, the circuit includes a drive waveform generating circuit that generates a common drive waveform in which plural drive pulses are arranged in time series; and a selection unit (driver IC) that selects desired drive pulses from the common drive waveform depending on image data and that applies the selected drive pulses to the corresponding individual piezoelectric elements included in the piezoelectric actuator. In such a case, the common drive waveform and the selected drive pulses are transmitted from the drive waveform generating circuit to the head through a flexible flat cable (FFC). However, the FFC includes resistance components, capacitance components, and inductance components. Further, the main components of the piezoelectric elements included in the piezoelectric type head are the capacitance components.

Therefore, when the number of the simultaneously driven piezoelectric elements is increased, the resonant frequency of a closed loop circuit in the piezoelectric type head is varied. Here, the closed loop circuit starts from the drive waveform generating circuit and ends at the drive waveform generating circuit through the piezoelectric elements. On the other hand, when the drive frequency of the drive waveform coincides with the resonant frequency, as the drive frequency of the head is increased so as to perform high-speed printing, gain of the waveform is increased, and a waveform having amplitudes exceeding desired signal levels is applied to the piezoelectric elements. In such a case, since a discharging speed and a discharging amount of liquid droplets are increased, the sizes of dots to be formed are enlarged. Therefore, there is a problem that density irregularities occur and image quality is lowered.

In regard to the relationship between the drive frequency of the drive waveform and the resonant frequency in the drive circuit, the following technique has conventionally been known. For example, a start-up time of a voltage of a waveform applied to piezoelectric elements is controlled so that the start-up time of the voltage becomes longer than a resonant period specific to the piezoelectric elements (Patent Document 1 (Japanese Published Unexamined Application No. H10-146970)).

Further, in regard to the variation of the drive waveform, the following technique has been known. In the technique, the following circuit is used as a driving circuit for driving plural piezoelectric elements. Namely, the circuit includes sets of three analog switches, the three analog switches being connected in parallel to the corresponding piezoelectric element. Here, the sets of three analog switches are connected in parallel. At every discharging timing, accumulated image data is obtained from image data. The variation of the waveform is suppressed by switching the selected analog switch among the analog switches, depending on the threshold value that has been set (Patent Document 2 (Japanese Published Unexamined Application No. 2008-254204)).

Further, a technique that handles a drive waveform as information about inflection points has been known. In the technique, a waveform input to a piezoelectric element is regulated to be constant by varying the inflection points in accordance with the number of the simultaneously driven piezoelectric elements (Patent Document 3 (Japanese Published Unexamined Application No. 2002-036535)).

However, in the configuration disclosed in Patent Document 1, driving voltage itself may be varied. Thus there is a problem that the control is complicated.

Further, for the configuration disclosed in Patent Document 2, peaking (a phenomenon that signal gain of a drive waveform becomes extremely large) is not considered. Here, peaking is caused by inductance components included in a transmission line connecting a drive waveform generating circuit and a recording head. Therefore, there is a problem that the variation of the waveform associated with an increase of the number of simultaneously driven piezoelectric element may not be suppressed.

Further, with the configuration disclosed in Patent Document 3, the drive waveform may be corrected based on information about the original waveform. However, since the inflection points are varied, a drive waveform that includes correction information and to be output from a drive waveform generating circuit includes more high frequency components, compared to a drive waveform that does not include correction information. Therefore, higher-performance elements may be required, and there is a problem that the cost is increased.

The embodiments of the present invention have been developed in view of the above described problems. An objective of the embodiments is to improve image quality by reducing variation of a drive waveform caused by variation of the number of simultaneously driven piezoelectric materials, and by reducing variation of discharging characteristic.

SUMMARY OF THE INVENTION

In one aspect, there is provided an image forming device including a liquid discharge head including plural piezoelectric elements for generating pressure for discharging liquid droplets; a drive waveform generating unit that generates and outputs a drive waveform for driving plural of the piezoelectric elements; a selection unit that selectively applies the drive waveform from the drive waveform generating unit to plural of the piezoelectric elements in accordance with a print image; a resonant frequency adjusting circuit including at least one of an inductance component and a capacitance component, the resonant frequency adjusting circuit being disconnectably connected in parallel with plural of the piezoelectric elements; a switch unit that switches between connection and disconnection of the resonant frequency adjusting circuit; and a switching control unit that causes the switch unit to switch in accordance with a first number of simultaneously driven piezoelectric elements among plural of the piezoelectric elements. When the first number of the simultaneously driven piezoelectric elements is greater than or equal to a predetermined number, the switching control unit causes the switch unit to switch to a state where the resonant frequency adjusting circuit is connected, so that plural of the piezoelectric elements are connected in parallel with the at least one of the inductance component and the capacitance component, and so that a resonant frequency of a closed loop that starts from the drive waveform generating unit and ends at the drive waveform generating unit through the liquid discharge head becomes lower than a resonant frequency of the closed loop when the first number of the simultaneously driven piezoelectric elements is less than the predetermined number.

In another aspect, there is provided an image forming device including a liquid discharge head including plural piezoelectric elements for generating pressure for discharging liquid droplets; a drive waveform generating unit that generates and outputs a drive waveform for driving plural of the piezoelectric elements; a selection unit that selectively applies the drive waveform from the drive waveform generating unit to plural of the piezoelectric elements in accordance with a print image; a resonant frequency adjusting circuit including at least one of an inductance component and a capacitance component, the resonant frequency adjusting circuit being disconnectably connected in parallel with plural of the piezoelectric elements; a switch unit that switches between connection and disconnection of the resonant frequency adjusting circuit; and a switching control unit that causes the switch unit to switch in accordance with a first number of simultaneously driven piezoelectric elements among plural of the piezoelectric elements. When the first number of the simultaneously driven piezoelectric elements is greater than or equal to a predetermined number, the switching control unit causes the switch unit to switch to a state where the resonant frequency adjusting circuit is disconnected, so that plural of the piezoelectric elements are disconnected from the at least one of the inductance component and the capacitance component connected in parallel with plural of the piezoelectric elements, and so that a resonant frequency of a closed loop that starts from the drive waveform generating unit and ends at the drive waveform generating unit through the liquid discharge head becomes higher than a resonant frequency of the closed loop when the first number of the simultaneously driven piezoelectric elements is less than the predetermined number.

In another aspect, there is provided an image forming device including a liquid discharge head including plural piezoelectric elements for generating pressure for discharging liquid droplets; a drive waveform generating unit that generates and outputs a drive waveform for driving plural of the piezoelectric elements; a selection unit that selectively applies the drive waveform from the drive waveform generating unit to plural of the piezoelectric elements in accordance with a print image; first and second transmission lines for transmitting the drive waveform from the drive waveform generating unit; a switch unit that switches between the first transmission line and the second transmission line; and a switching control unit that causes the switch unit to switch in accordance with a first number of simultaneously driven piezoelectric elements among plural of the piezoelectric elements. Here, a first impedance component of the first transmission line is less than a second impedance component of the second transmission line. When the first number of the simultaneously driven piezoelectric elements is less than a predetermined number, the switching control unit causes the switch unit to switch to the second transmission line. Further, when the first number of the simultaneously driven piezoelectric elements is greater than or equal to the predetermined number, the switching control unit causes the switch unit to switch to the first transmission line.

In another aspect, there is provided an image forming device including a liquid discharge head including plural piezoelectric elements for generating pressure for discharging liquid droplets; a drive waveform generating unit that generates and outputs a drive waveform for driving plural of the piezoelectric elements; a selection unit that selectively applies the drive waveform from the drive waveform generating unit to plural of the piezoelectric elements in accordance with a print image; plural circuits that are disconnectably connected to a closed loop that starts from the drive waveform generating unit and ends at the drive waveform generating unit through the liquid discharge head, wherein each of the circuits includes at least one of an inductance component and a capacitance component; a switch unit that switches between connection and disconnection of each of the circuits; and a switching control unit that causes the switch unit to switch in accordance with a first number of simultaneously driven piezoelectric elements among plural of the piezoelectric elements. The switching control unit selects circuits to be connected to the closed loop among plural of the circuits in accordance with the first number of simultaneously driven piezoelectric elements, and the switching control unit causes the switching unit to connect the selected circuits to the closed loop and to disconnect the circuits other than the selected circuit from the closed loop, so as to vary a resonant frequency of the closed loop in accordance with the first number of the simultaneously driven piezoelectric elements.

Other objects, features and advantages of the present invention will become more apparent from the following detailed description when read in conjunction with the accompanying drawings.

BRIEF DESCRIPTION OF THE DRAWINGS

FIG. 143 is a diagram illustrating an output waveform when only one channel is driven in the comparative example;

FIG. 18 is a diagram illustrating the number of simultaneously driven channels and ON/OFF states of switches in the fifth embodiment;

DETAILED DESCRIPTION OF THE PREFERRED EMBODIMENTS

Figure 1:
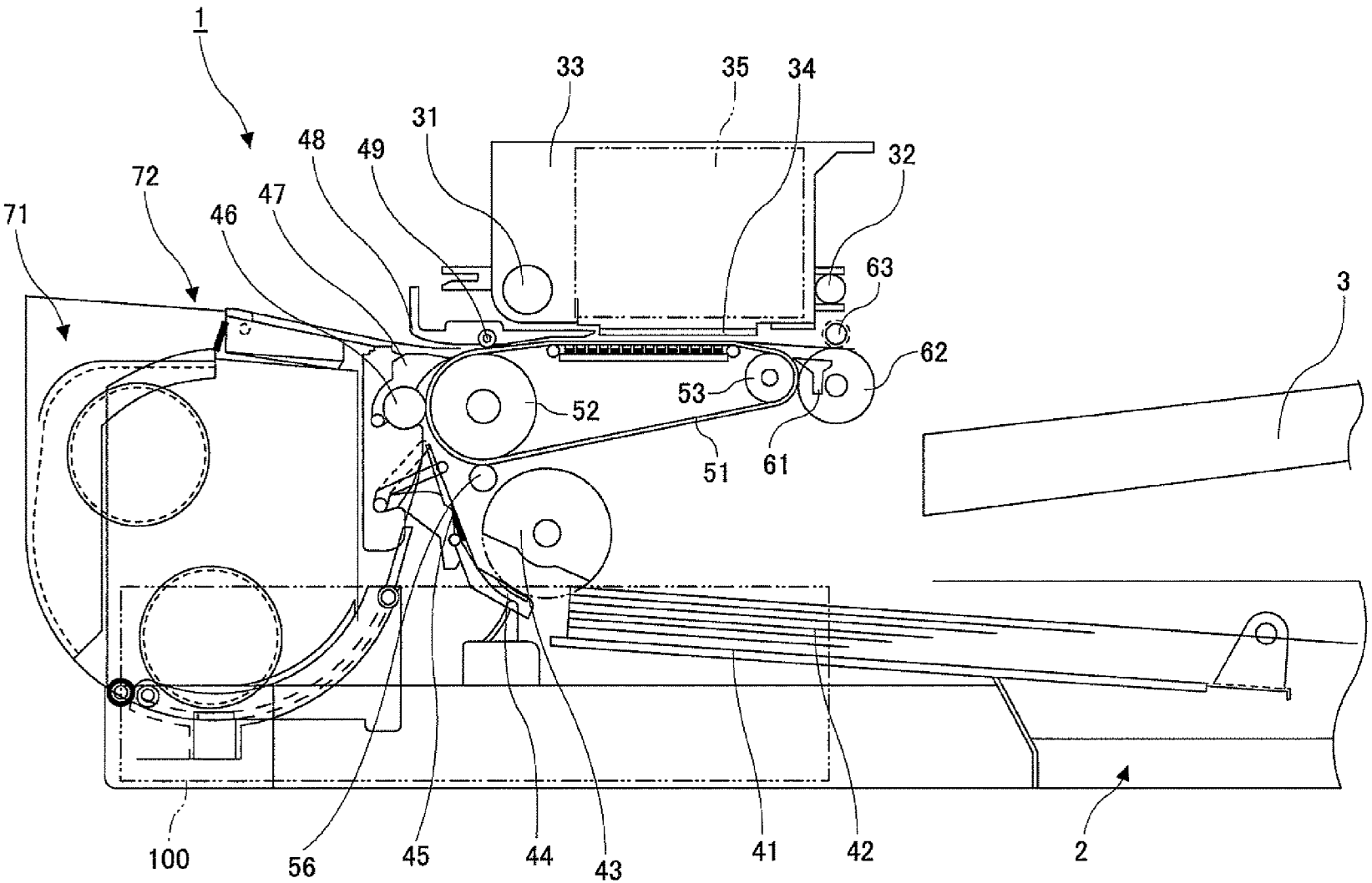
FIG. 1 is a side view illustrating an overall configuration of mechanical portions of an image forming device according to an embodiment.
Figure 2:
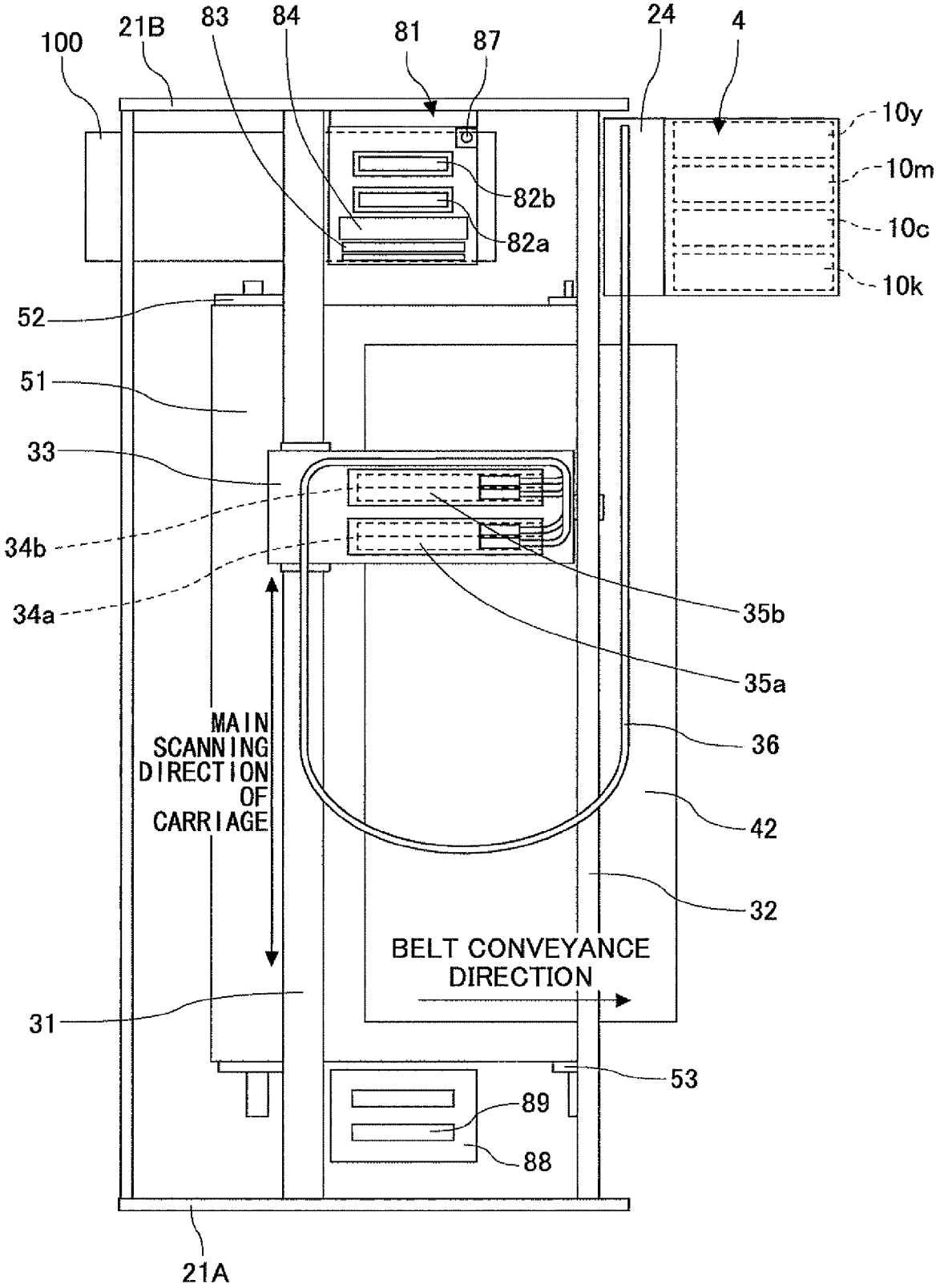
FIG. 2 is a top view illustrating the mechanical portions of the image forming device.

Hereinafter, an embodiment of the present invention is explained by referring to the accompanying figures. First, an example of an image forming device according to an embodiment is explained by referring to FIGS. 1 and 2. Here, FIG. 1 is a side view illustrating an overall configuration of the image forming device 1, and FIG. 2 is a top view illustrating the mechanical portions of the image forming device 1. The image forming device 1 is a serial-type inkjet recording device. In the image forming device 1, a carriage 33 is slidably supported by a main guide rod 31 and a sub guide rod 32 that are supported by a left side plate 21A and a right side plate 21B of the main body of the image forming device 1. The carriage 33 is able to slide in the main scanning direction. The carriage 33 moves and scans in the direction indicated by arrows (carriage main scanning direction) in FIG. 2 by a main scanning motor (not shown) through a timing belt.

The carriage 33 includes recording heads 34*a* and 34*b* (when the recording heads 34*a* and 34*b* are not distinguished, they are referred to as "the recording heads 34). Each of the recording heads 34*a* and 34*b* includes liquid discharge heads that discharge yellow (Y) ink droplets, cyan (C) ink droplets, magenta (M) ink droplets, and black (K) ink droplets, respectively. The recording heads 34*a* and 34*b* are attached to the carriage 33 so that nozzle lines of plural nozzles are arranged in a sub-scanning direction perpendicular to the main scanning direction and an ink discharging direction is directed downward.

Each of the recording heads 34 includes two nozzle lines. In the recording head 34*a*, one of the two nozzle lines discharges the black (K) ink droplets and the other nozzle line discharges the cyan (C) ink droplets. In the recording head 34*b*, one of the two nozzle lines discharges the magenta (M) ink droplets and the other nozzle line discharges the yellow (Y) ink droplets. Further, as the recording head 34, the following recording head may be used. Namely, a recording head includes nozzle lines corresponding to yellow (Y), cyan (C), magenta (M), and black (K), respectively, where the plural nozzles are arranged on a single nozzle surface.

Further, the carriage 33 includes, as a second ink supply unit, head tanks 35*a* and 35*b* (when the head tanks 35*a* and 35*b* are not distinguished, they are referred to as "the head tanks 35). The head tanks 35*a* and 35*b* supply the yellow (Y) ink, the cyan (C) ink, the magenta (M) ink, and the black (K) ink to the corresponding nozzle lines of the recording heads 34. A supply pump unit 24 supplies the yellow (Y) ink, the cyan (C) ink, the magenta (M) ink, and the black (K) ink from an yellow ink cartridge 10*y*, a cyan ink cartridge 10*c*, a magenta ink cartridge 10*m*, and a black ink cartridge 10*k* (main tanks) to the head tanks 35 through supply tubes 26. Here, the main tanks are detachably attached to a cartridge loading unit 4.

The image forming device 1 includes, as a sheet feeding unit for feeding sheets 42 stacked on a sheet stacking unit 41

(a platen) of a sheet feeding tray 2, a semilunar roller (a sheet feeding roller) 43 that separates the sheets 42 from the sheet stacking unit 41 and feeds the separated sheet 42 one by one; and a separation pad 44 that faces the sheet feeding roller 43. The separation pad 44 is formed of a material having a high friction coefficient. The separation pad 44 is pressed toward the sheet feeding roller 43.

The image forming device 1 includes a guide member 45 for guiding the sheet 42; a counter roller 46; a conveyance guide member 47; and a pressing member 48 having a tip pressing roller 49, so as to forward the sheet 42 fed from the sheet feeding unit to a position under the recording head 34. Further, the image forming device 1 includes a conveyance belt 51 as a conveyance unit that electrostatically suctions the fed sheet 42 and conveys the sheet 42 to the position facing the recording head 34.

The conveyance belt 51 is an endless belt. The conveyance belt 51 is supported by a conveyance roller 52 and a tension roller 53, and the conveyance belt 51 rotationally moves in a belt conveyance direction (the sub-scanning direction). Further, the image forming device 1 includes a charging roller 56, which is a unit for charging the surface of the conveyance belt 51. The charging roller 56 contacts the surface of the conveyance belt 51, and the charging roller 56 is arranged to be driven by the rotation of the conveyance belt 51. The conveyance belt 51 is rotationally driven in the belt conveyance direction by the rotation of the conveyance roller 52, when the conveyance roller 52 is driven by a sub-scanning motor (not shown in the figures) through the timing belt.

Further, as a paper discharging unit for discharging the sheet 42, which has been recorded on by the recording head 34, the image forming device 1 includes a separation nail 61 for separating the sheet 42 from the conveyance belt 51; a discharging roller 62; and a spur 63. Here, the spur 63 is an ejection roller. Further, the image forming device 1 includes a sheet discharge tray 3 placed under the discharging roller 62.

Further, in a rear side portion of the main body of the image forming device 1, a double-sided unit 71 is detachably attached. The double-sided unit 71 takes in the sheet 42, which is returned by reverse rotation of the conveyance belt 51, and feeds the sheet 42 between the counter roller 46 and the conveyance belt 51. Further, the upper surface of the double-sided unit 71 is a manual feeding tray 72.

Further, in a non-printing area on one side in the main scanning direction of the carriage 33, a maintenance recovery unit 81 for maintaining and recovering states of the nozzles of the recording head 34 is arranged. The maintenance recovery unit 81 includes cap members (hereinafter, referred to as "caps") 82*a* and 82*b* (when the caps 82*a* and 82*b* are not distinguished, they are referred to as "the caps 82") for capping the nozzle surfaces of the recording head 34; a wiper blade 83 that is a blade member for wiping the nozzle surfaces; an idle discharge receiving unit 84; and a carriage lock 87 for locking the carriage. Here, the idle discharge receiving unit 84 receives liquid droplets that are discharged when an idle discharge for discharging the liquid droplets which do not contribute for recording is performed, so as to discharge the thickened ink. Further, below the maintenance recovery unit 81 of the recording head 34, a waste liquid tank 100 is replaceably attached to the main body of the image forming device 1. The waste liquid tank 100 is for storing a waste liquid produced during the maintenance and recovery operation.

Further, in the other non-printing area in the main scanning direction of the carriage 33, an idle discharge receiving unit 88 is arranged for receiving liquid droplets, when an idle discharge for discharging the liquid droplets which do not contribute for recording is performed, in order to discharge the thickened ink during recording. In the idle discharge receiving unit 88, an opening portion 89 is arranged along the direction of the nozzle lines of the recording head 34.

In the image forming device 1, which is configured in such a manner, the sheets 42 from the sheet feeding tray 2 are separated, and the separated sheet 42 is fed one by one. The sheet 42, which is fed almost vertically upwards, is guided by the guide member 45, and conveyed while the sheet 42 is pinched between the conveyance belt 51 and the counter roller 46. Further, the tip of the sheet 42 is guided by a conveyance guide 37, and the tip of the sheet 42 is pressed by the tip pressing roller 49 toward the conveyance belt 51. Then the conveyance direction of the sheet 42 is switched by almost 90 degrees.

At this time, plus and minus outputs are alternately and repeatedly applied to the charging roller 56, namely alternating voltages are applied to the charging roller 56. Then, on the conveyance belt 51, an alternating charged voltage pattern is formed. When the sheet 42 is fed on the conveyance belt 51, which has been charged, the sheet 42 is adhered to the conveyance belt 51, and the sheet is conveyed in the sub-scanning direction by the rotational movement of the conveyance belt 51.

Then, by driving the recording head 34 in accordance with the image signal while moving the carriage 33, the ink droplets are discharged onto the suspended sheet 42 and an amount corresponding to one line is recorded. After conveying the sheet 42 by a predetermined conveyance amount, the next recording is performed. When a record termination signal is received or a signal indicating that the back end of the sheet 42 has reached the recording area is received, the recording operation is terminated and the sheet 42 is discharged onto the sheet discharge tray 3.

When the maintenance and recovery operation for the nozzles of the recording head 34 is performed, the carriage 33 is moved to a position facing the maintenance recovery unit 81, which is a home position of the carriage 33. After the recording head 34 is capped with the caps 82, the maintenance and recovery operation, such as a nozzle suction operation for suctioning the nozzles, or the idle discharging operation for discharging the liquid droplets which do not contribute for the image formation, is performed. With this, an image can be formed by stable discharging of liquid droplets.

Figure 3:
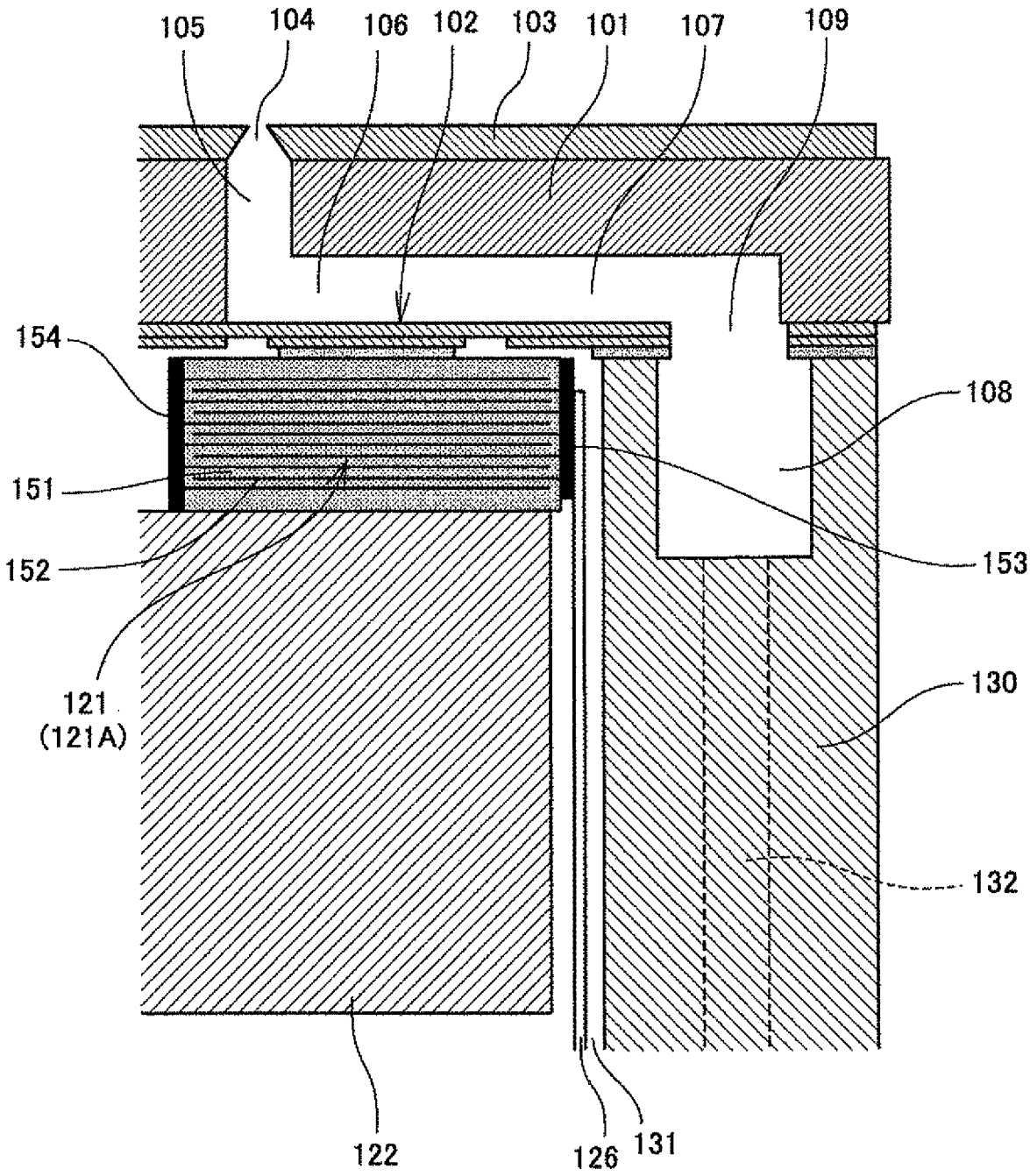
FIG. 3 is a sectional explanatory view, in a longitudinal direction of a liquid chamber, showing an example of a liquid discharge head included in a recording head of the image forming device.
Figure 4:
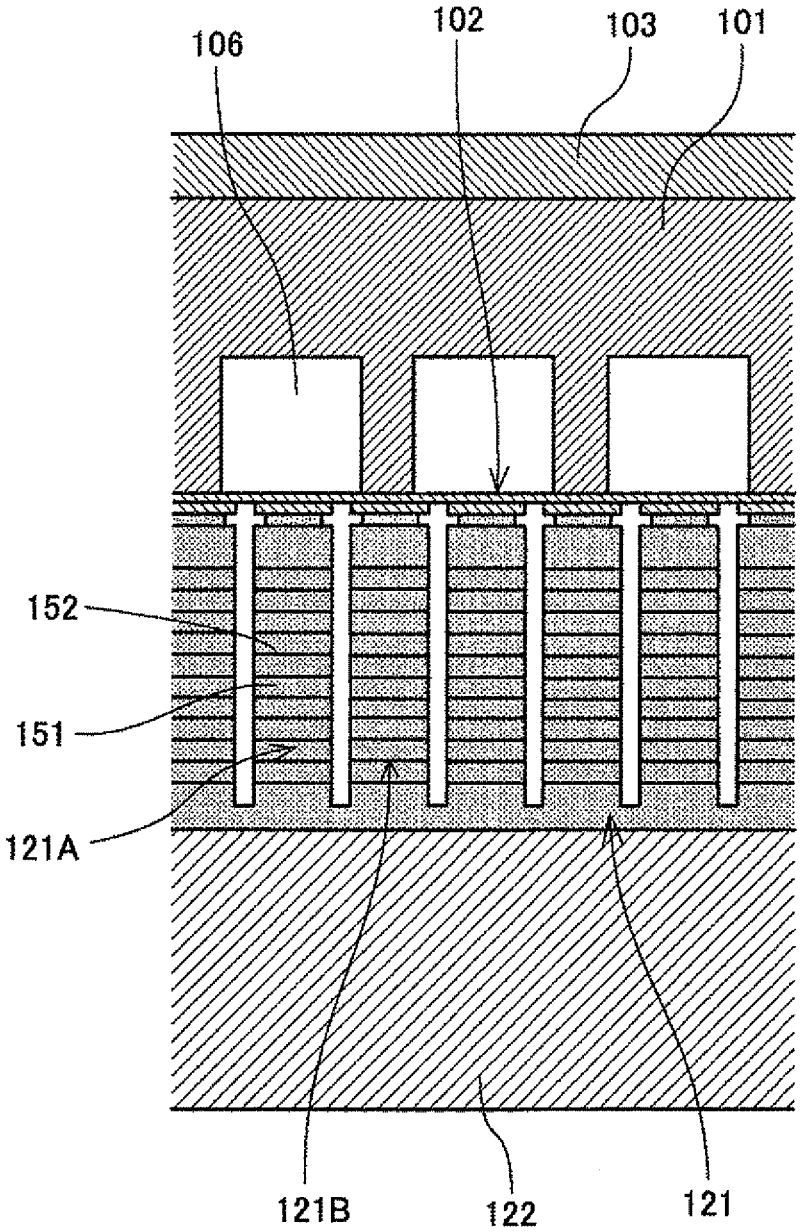
FIG. 4 is a sectional explanatory view of the liquid discharge head in a short hand direction of the liquid chamber.

Hereinafter, an example of the liquid discharge head included in the recording head 34 is explained by referring to FIGS. 3 and 4. Here, FIG. 3 is a sectional explanatory view of the liquid discharge head in a longitudinal direction of a liquid chamber, and FIG. 4 is a sectional explanatory view of the liquid discharge head in a short hand direction of the liquid chamber.

The liquid discharge head includes a fluid channel board 101, an oscillation plate 102 joined to a bottom surface of the fluid channel board 101, and a nozzle plate 103 joined to an upper surface of the fluid channel board 101. The fluid channel board 101, the oscillation plate 102 and the nozzle plate 103 are joined together and laminated. These elements form, at least, a nozzle communication channel 105 which is a fluid channel communicating with a nozzle 104 that discharges liquid droplets (ink droplets); a compression liquid chamber (hereinafter, referred to as the liquid chamber) 106 which is a chamber for generating pressure; and an ink supply port 109 communicating with a common liquid chamber for supplying ink to the liquid chamber 106 through a fluid resistance portion (supply channel) 107.

The liquid discharge head includes two laminated type piezoelectric members 121 as electromechanical transducers, and a base substrate 122. The piezoelectric members 121 function as pressure generating units (actuator units) for causing the oscillation plate 102 to deform so as to apply pressure to the ink inside the liquid chamber 106. The base substrate 122 is joined to the piezoelectric members 121 and the piezoelectric members 121 are fixed on the base substrate 122. On each of the piezoelectric members 121, plural piezoelectric poles 121A and plural piezoelectric poles 121B are formed by forming grooves by applying slit processing in which the piezoelectric members 121 are not divided. In the example, the piezoelectric poles 121A are driving piezoelectric poles to which corresponding driving waveforms are applied. The piezoelectric poles 121B are non-driving piezoelectric poles to which no driving waveforms are applied. Further, a FPC cable 126 is connected to the piezoelectric poles 121A of each of the piezoelectric members 121. Here, the FPC cable 126 includes a driving circuit (driving IC) which is not shown in the figures.

Further, fringe portions of the oscillation plate 102 are joined to a frame member 130. In the frame member 130, at least, a penetration hole 131, a concaved portion that functions as the common liquid chamber 108, and an ink supply channel 132 are formed. Here, the penetration hole 131 stores the actuator units including, at least, the piezoelectric members 121 and the base substrate 122. The ink supply channel 132 is a liquid supply port for supplying the ink from the outside to the common liquid chamber 108.

Here, the fluid channel board 101 is formed of, for example, a single-crystal silicon substrate having a crystal orientation of (110). The convex portions and the concave portions, such as the nozzle communication channel 105 and the liquid chamber 106, are formed by applying isotropic etching to the single-crystal silicon substrate using an alkaline etching solution, such as a potassium hydroxide (KOH) solution. However, the material of the fluid channel board 101 is not limited to the single-crystal silicon substrate. A stainless substrate or a photosensitive resin may be used as a material of the fluid channel board 101.

The oscillation plate 102 is formed of a metal plate of nickel (Ni). The oscillation plate 102 is manufactured by an electro-forming method (electromolding). Additionally, a metal plate or a bonding member, in which a metal and a resin plate are bonded together, may be utilized as a material of the oscillation plate 102. The piezoelectric poles 121A and 121B of the piezoelectric members 121 are adhesively bonded to the oscillation plate 102. Further, the frame member 130 is adhesively bonded to the oscillation plate 102.

The nozzles 104 having a diameter from 10 μm to 30 μm are formed on the nozzle plate 103. The nozzle plate 103 is adhesively bonded to the fluid channel board 101. The nozzle plate 103 includes a nozzle forming member formed of a metal member. Here, a water repellent layer is formed as the outermost surface of the metal member through a required layer.

Each of the piezoelectric members 121 is a laminated type piezoelectric element (here PZT) such that a piezoelectric material 151 and internal electrodes 152 are alternately laminated. The internal electrodes 152 are alternately extended to different end faces of each of the piezoelectric members 121. An individual electrode 153 is connected to the internal electrodes 152 extended to one of the end faces. A common electrode 154 is connected to the internal electrodes 152 extended to the other end face. In the embodiment, as a piezoelectric direction of the piezoelectric members 121, a deformation in the d33 direction is utilized to apply pressure to the ink inside the liquid chamber 106. However, as the piezoelectric direction of the piezoelectric members 121, a deformation in the d31 direction may be utilized to apply pressure to the ink inside the liquid chamber 106.

In the liquid discharge head configured as described above, when a voltage applied to, for example, one of the driving piezoelectric pole 121A is decreased from a reference voltage Ve, the piezoelectric pole 121A shrinks. Then the oscillation plate 102 is moved downward and a volume of the liquid chamber 106 is enlarged. Thus the ink inflows into the liquid chamber 1066. Subsequently, the voltage applied to the driving piezoelectric pole 121A is increased, so as to extend the driving piezoelectric pole 121A. Then the oscillation plate 102 is deformed toward the nozzle 104 and the volume of the liquid chamber 106 is shrunk. Accordingly, the ink inside the liquid chamber 106 is pressed, and the ink droplets are discharged (sprayed) from the nozzle 104.

When the voltage applied to the driving piezoelectric pole 121A is returned to the reference voltage, the oscillation plate 102 returns to its original position. Then the liquid chamber 106 is enlarged and negative pressure is generated. Thus the ink is supplied from the common liquid chamber 108 to the liquid chamber 106. After the oscillation of the meniscus surface in the nozzle 104 is attenuated and the meniscus surface is stabilized, the process proceeds to an operation for the next discharging.

Incidentally, the method of driving the head is not limited to the above example (a pull-push-out method). Depending on a waveform to be input, a pull-out method or a push-out method may be utilized.

Figure 5:
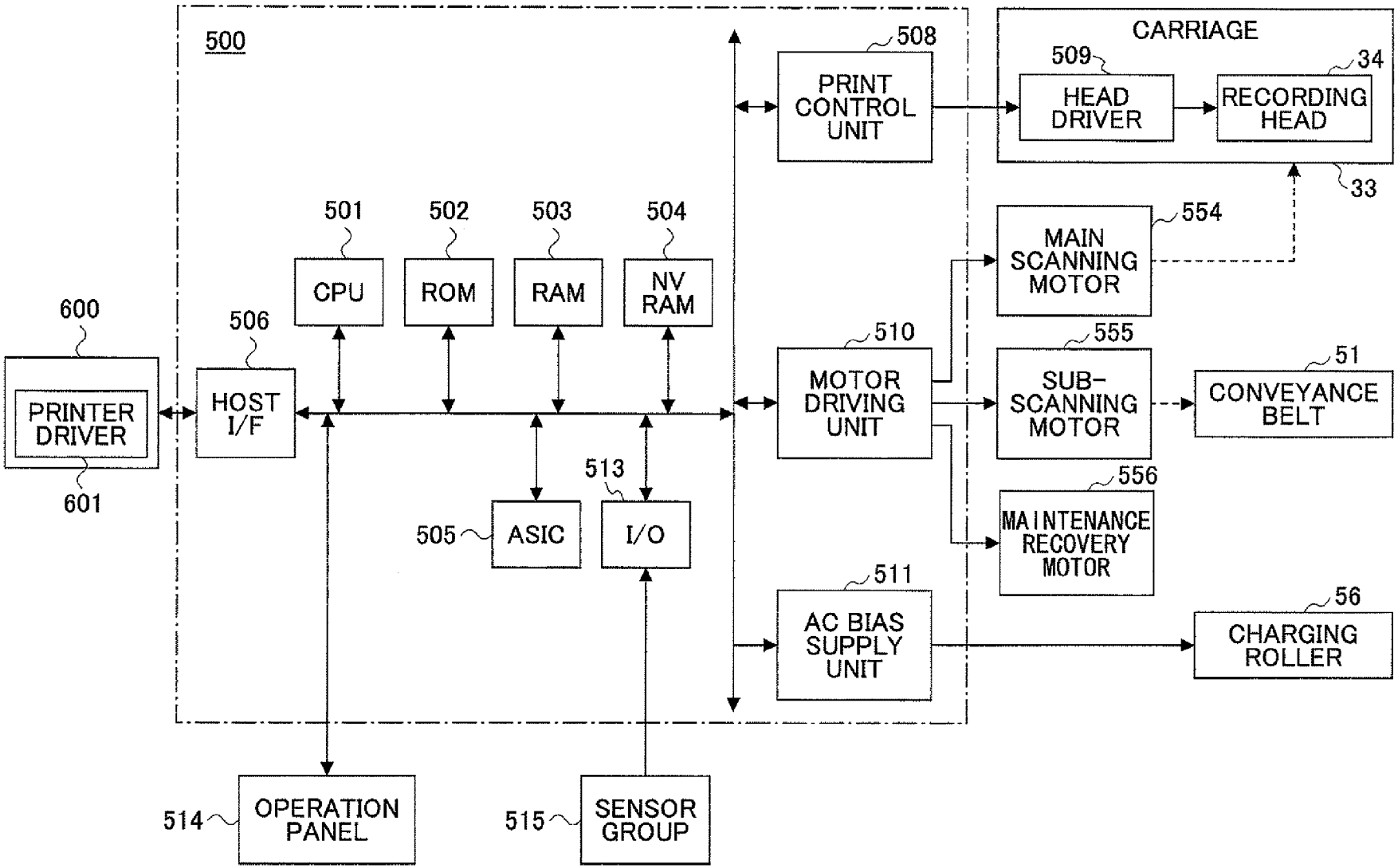
FIG. 5 is a block diagram illustrating an outline of a control unit of the image forming device.

Hereinafter, an overall configuration of a control unit 500 of the image forming device 1 is explained by referring to FIG. 5. Here, FIG. 5 is a block diagram illustrating the control unit 500. The control unit 500 includes a CPU 501; a ROM 502; a RAM 503; a non-volatile memory 504; and an ASIC 505. The CPU 501 is responsible for overall control of the image forming device 1. The ROM 502 stores fixed data, such as a program executed by the CPU 501. The RAM 503 temporary stores image data or the like. The non-volatile memory 504 is a rewritable memory that retains data even when the image forming device 1 is turned off. The ASIC 505 applies various signal processes to image data, performs image processing, such as sorting, and processes input/output signals for controlling the entire image forming device 1.

Further, the control unit 500 includes, at least, a print control unit 508, a motor driving unit 510, and an AC bias supply unit 511. The print control unit 508 includes a data transfer unit for driving and controlling the recording head 34 and a drive waveform generating unit. The motor driving unit 510 includes a head driver (driver IC) 509 for driving the recording head 34. The head driver 509 is included in the carriage 33. The motor driving unit 510 drives a main scanning motor 554 that moves the carriage 33, a sub-scanning motor 555 that rotationally moves the conveyance belt 51, and a maintenance recovery motor 556 that moves the caps 82 and the wiper blade 83 of the maintenance recovery unit 81. The AC bias supply unit 511 supplies an AC bias to the charging roller 56.

Further, an operation panel 514 for inputting information to the image forming device 1 and for displaying information is connected to the control unit 500.

The control unit 500 further includes an I/F 506 for transmitting signals to a host 600 and receiving signals from the host 600. The control unit 500 receives signals from the host 600, such as an information processing device, e.g., a personal computer; an image reading device, e.g., an image scanner; or an imaging device, e.g., a digital camera, using the I/F 506 through a cable or a network.

The CPU 501 of the control unit 500 reads out print data stored in a receiving buffer included in the I/F 506 and analyzes the print data. Then the CPU 501 causes the ASIC 505 to perform necessary image processing and data sorting. Subsequently, the CPU 501 transmits the image data from the print control unit 508 to the head driver 509. Incidentally, dot pattern data for outputting the image may be generated by the printer driver 601 included in the host 600 or may be generated by the control unit 500.

The print control unit 508 transmits the above described image data as serial data to the head driver 509. Additionally, the print control unit 508 transmits, for example, a transfer clock signal, a latch signal, and a control signal that may be required for transmitting the image data and confirming the transmission of the image data. Further, the print control unit 508 includes a drive signal generating unit that includes a D/A convertor that converts pulse pattern data of drive pulses stored in the ROM, a voltage amplifier, and a current amplifier. The print control unit, 508 outputs a drive waveform formed of a single drive pulse or plural drive pulses as a common drive waveform to the head driver 509.

Based on the image data corresponding to one line, which is serially input to the recording head 34, the head driver 509 selects the drive pulses included in the common drive waveform, which has been output from the print control unit 508, and generates a discharge pulse. Subsequently, the head driver 509 drives the recording head 34 by applying the discharge pulse to the piezoelectric poles 121A. Here, the piezoelectric poles 121A function as pressure generating units that generate forces for the recording head 34 to discharge liquid droplets. At that time, the head driver 509 may, for example, distinguish and print dots having different sizes, such as a large dot, a middle dot, and a small dot, by selecting a portion of or all the drive pulses included in the drive waveform, or by selecting elements of a waveform forming a pulse.

The control unit 500 further includes an I/O unit 513. The I/O unit 513 obtains information from a sensor group 515 that includes various sensors connected to the image forming device 1. The I/O unit 513 extracts information that may be required for controlling the printer from the obtained information, and utilizes the extracted information for controlling the print control unit 508, the motor driving unit 510, or the AC bias supply unit 511. The sensor group 515 includes, for example, an optical sensor for detecting a position of a sheet; a thermistor for monitoring temperature inside the image forming device 1; a sensor for monitoring voltages on a charged belt; and an interlock switch for detecting opening and closing of a cover. The I/O unit 513 can process various sensor information.

Figure 6:
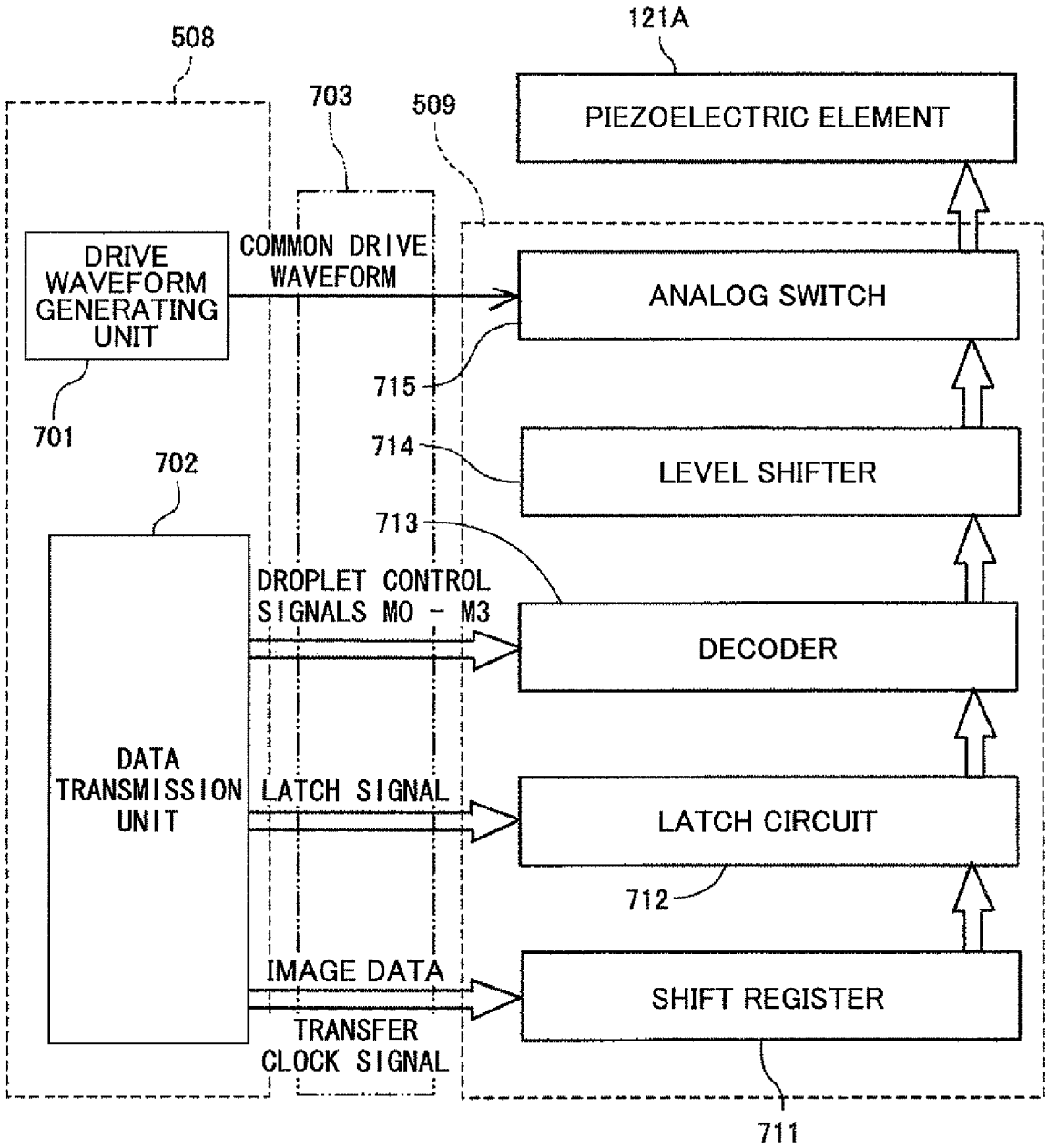
FIG. 6 is a block diagram illustrating a print control unit of the control unit and an example of a head driver.

Hereinafter, an example of the print control unit 508 and an example of the head driver 509 are explained by referring to FIG. 6. The print control unit 508 includes a drive waveform generating unit 701 and a data transmission unit 702. The drive waveform generating unit 701 generates and outputs a drive waveform (a common waveform) formed of plural drive pulses (drive signals) included in a single print period (a single drive period) during image formation. The data transmission unit 702 outputs two-bit image data (tone signals: 0, 1) corresponding to a print image, the transfer clock signal, the latch signal (LAT), and droplet control signals M0-M3, during the image formation.

Here, the droplet control signals M0-M3 are two-bit signals for directing opening or closing of an analog switch 715 per each droplet. The analog switch 715 is a switch unit (described later) of the head driver 509. A state of each of the droplet control signals M0-M3 transitions to a H-level (ON) for a pulse or a waveform element to be selected, in synchronization with a print period of a common drive waveform. When a pulse or a waveform element is not to be selected, the state of each of the droplet control signals M0-M3 transitions to a L-level (OFF).

Further, the print control unit 508 included in the main body of the image forming device 1 and the head driver 509 included in the carriage 33 are connected through a FFC 703.

The head driver 509 includes a shift register 711; a latch circuit 712; a decoder 713; a level shifter 714; and the analog switch 715. The shift register 711 is for inputting the transfer clock signal (shift clock signal) and serial image data (tone data: two bits per one channel (one nozzle)) from the data transfer unit 702. The latch circuit 712 latches registered values of the shift register using the latch signal. The decoder 713 decodes the tone data and the droplet control signals M0-M3 and outputs the result. The level shifter 714 converts logic-level voltage signals from the decoder 713 into signals having levels, with which the analog switch 715 is able to operate. The analog switch 715 is turned on or turned off (opened or closed) by the output of the decoder 713, which is input to the analog switch 715 through the level shifter 714.

The analog switch 715 is connected to a selective electrode (the individual electrode) 153 of one of the driving piezoelectric poles 121A. Further, the common drive waveform from the drive waveform generating unit 701 is input to the analog switch 715. The analog switch 715 is turned on in accordance with the result of decoding the serially-transmitted image data (the tone data) and the droplet control signals M0-M3 using the decoder 713. Then, a desired pulse (or waveform element) included in the common drive waveform passes through (or is selected by) the analog switch 715 and is applied to the driving piezoelectric pole 121A.

Figure 7:
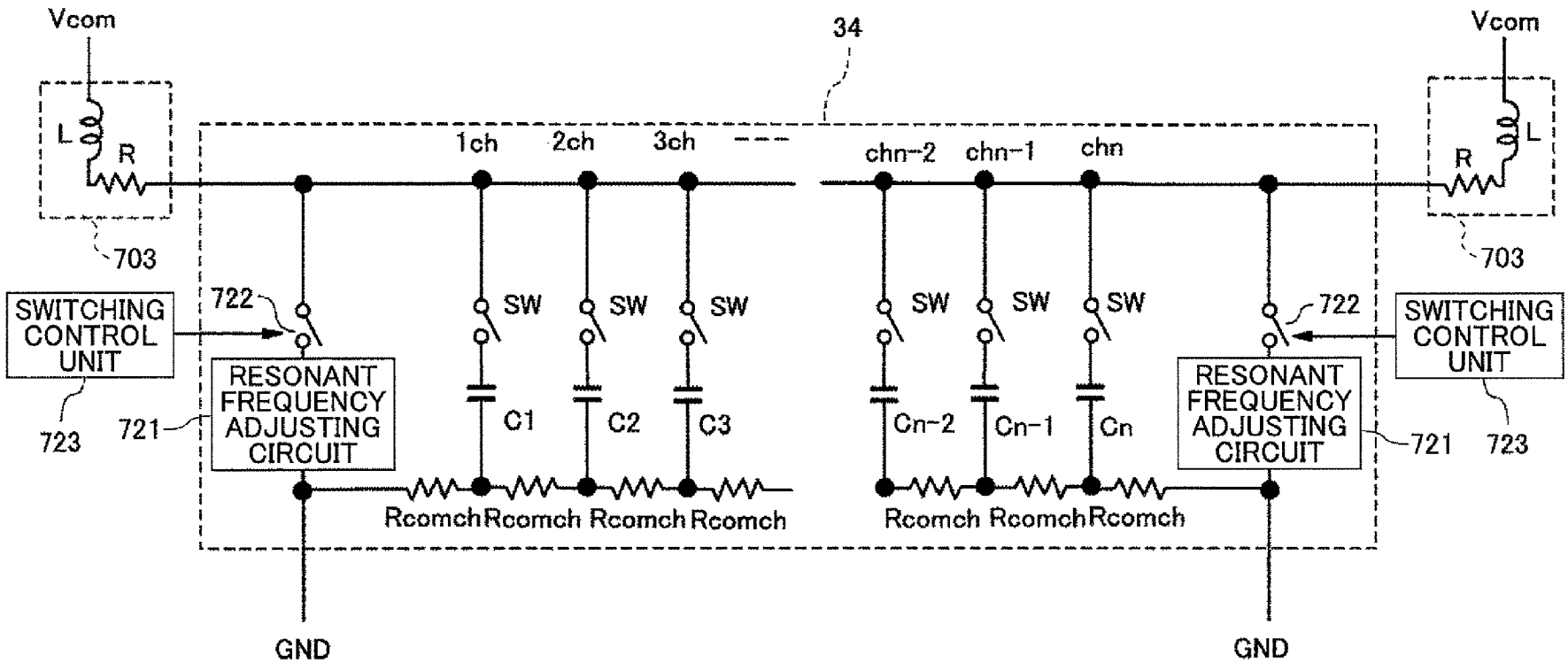
FIG. 7 is a diagram illustrating a circuit according to a first embodiment.

Hereinafter, a first embodiment of the present invention is explained by referring to FIG. 7. Here, FIG. 7 is a diagram illustrating a circuit according to the first embodiment. The recording head 34, which is the liquid discharge head, includes plural (n pieces of) nozzles 104. In FIG. 7, the n pieces of nozzles 104 are indicated as 1*ch* through nch. The recording head 34 includes the driving piezoelectric poles 121A corresponding to the 1*ch* through the nch, respectively. The driving piezoelectric poles 121A corresponding to the 1*ch* through the nch are indicated as piezoelectric poles C1 through Cn (each of the piezoelectric poles C1 through Cn is referred to as the piezoelectric element C) in FIG. 7. As described above, the head driver 509 includes the analog switches 715, which are turned on or turned off in accordance with the image data. Each of the analog switches 715 is indicated as "SW" in FIG. 7.

Electrically, the analog switch SW is serially connected to the piezoelectric element C. When the drive waveform Vcom is applied to a side of the analog switch SW, which is opposite to a side where the piezoelectric element C is connected, and when the analog switch SW is turned on, the drive waveform Vcom (to be precise, the selected drive pulse) is applied to the piezoelectric element C. Further, equivalently, sides of the piezoelectric elements C, which are opposite to sides where the switches SW are connected, are mutually connected through resistances Rcomch between the channels, and are connected to the GND through the above described common electrodes 154.

In the above configuration, a closed loop is formed within the recording head 34, provided that the recording head 34 is viewed from the drive waveform generating unit 701. Here, the closed loop starts from the drive waveform generating unit 701 and returns to the drive waveform generating unit 701 (i.e., connected to the GND) through the piezoelectric elements C included in the recording head 34.

In the closed loop, the FFC 703, which forms a transmission line connecting the drive waveform generating unit 701 and the head driver 509, has a resistance component R and an inductance component L.

Further, the piezoelectric elements C are connected in parallel with a series circuit formed of a resonant frequency adjusting circuit 721 and a switch 722 as a switching unit. Here, the resonant frequency adjusting circuit 721 includes at least one of an inductance component and a capacitance component.

The switch 722 is controlled to be turned on or off by an on/off signal (data) from a switching control unit 723 included in the side of the print control unit 508. When the number of simultaneously driven piezoelectric elements C is less than a predetermined number m, which is defined in advance, the switching control unit 723 separates (disconnects) the resonant frequency adjusting circuit 721 from the piezoelectric elements C by turning off the switch 722. On the other hand, when the number of the simultaneously driven piezoelectric elements C is greater than or equal to the predetermined number m, the switching control unit 723 connects the resonant frequency adjusting circuit 721 in parallel with the piezoelectric elements C by turning on the switch 722.

Figure 8:
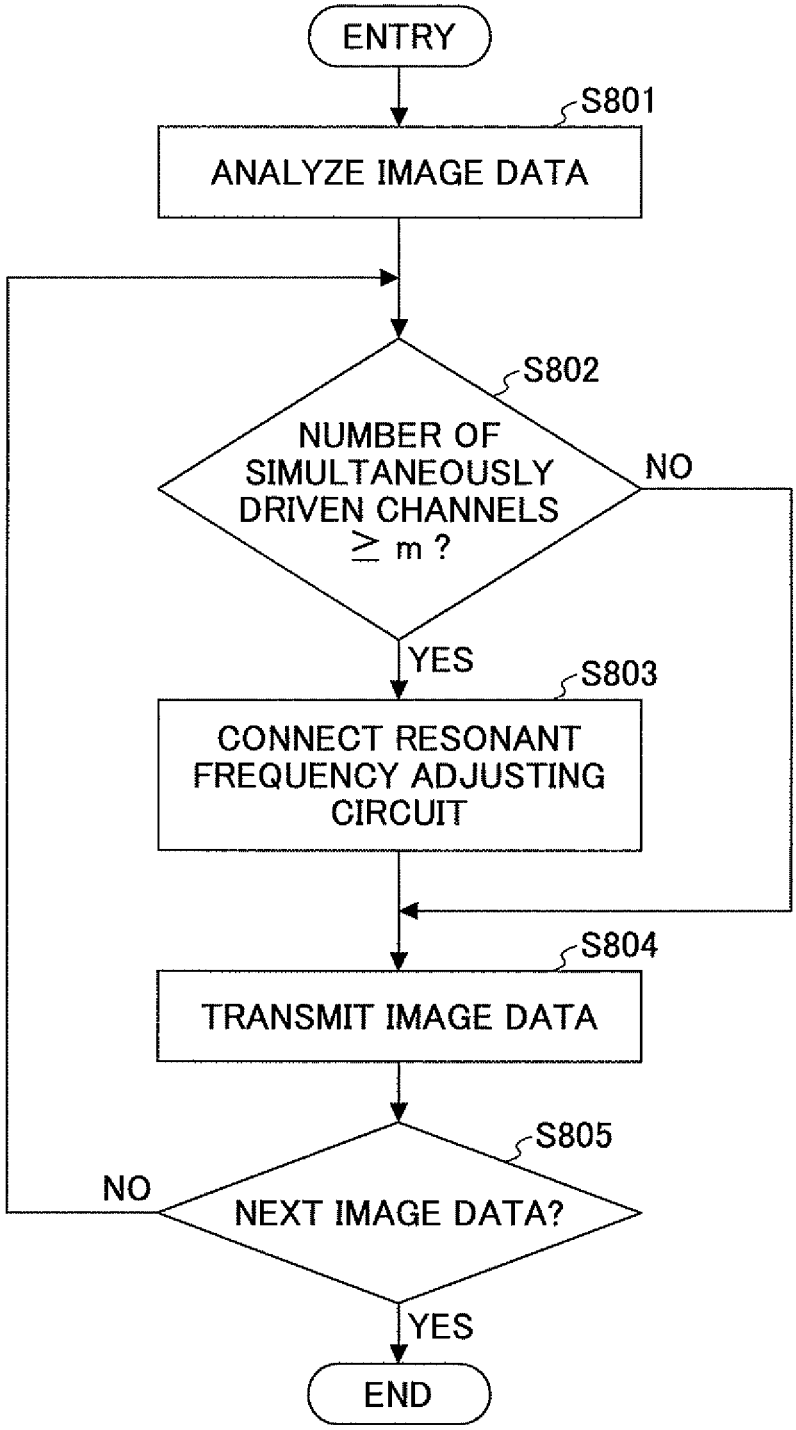
FIG. 8 is a flowchart illustrating a switching control according to the first embodiment.

Next, switching control performed by the print control unit 508 including the switching control unit 723 is explained by referring to a flowchart of FIG. 8. The print control unit 508 calculates the number of the piezoelectric elements C, which are simultaneously driven in a same drive period, from image data (S801). Then the print control unit 508 determines whether the calculated number of simultaneously driven channels is greater than or equal to the predetermined number m (S802).

When the print control unit 508 determines that the number of the simultaneously driven channels is greater than or equal to the predetermined number m, the print control unit 508 causes the switching control unit 723 to output a signal which turns on the switch 722. With this, during the drive period, the switch 722 is turned on, and the resonant frequency adjusting circuit 721, which includes at least one of the inductance component and the capacitance component, is connected in parallel with the piezoelectric elements C (S803).

When the print control unit 508 determines that the number of the simultaneously driven channels is less than the predetermined number m, the print control unit 508 leaves the switch 722 turned off. With this, during the drive period, the resonant frequency adjusting circuit 721, which includes at least one of the inductance component and the capacitance component, is left disconnected.

Then the print control unit 508 transmits the image data (S804), and, as described above, the piezoelectric elements C are driven in accordance with the image data and liquid droplets are discharged. Subsequently, when the print control unit 508 determines that there is existing next image data (S805), the process returns to the process of calculating the number of simultaneously driven channels.

Therefore, when the number of simultaneously driven channels is greater than or equal to the predetermined number m, the resonant frequency of the closed loop is decreased to a frequency, which is lower than the resonant frequency corresponding to the number of the driven channels, by connecting the resonant frequency adjusting circuit 721, which includes at least one of the inductance component and the capacitance component, in parallel with the piezoelectric elements C.

Figure 9:
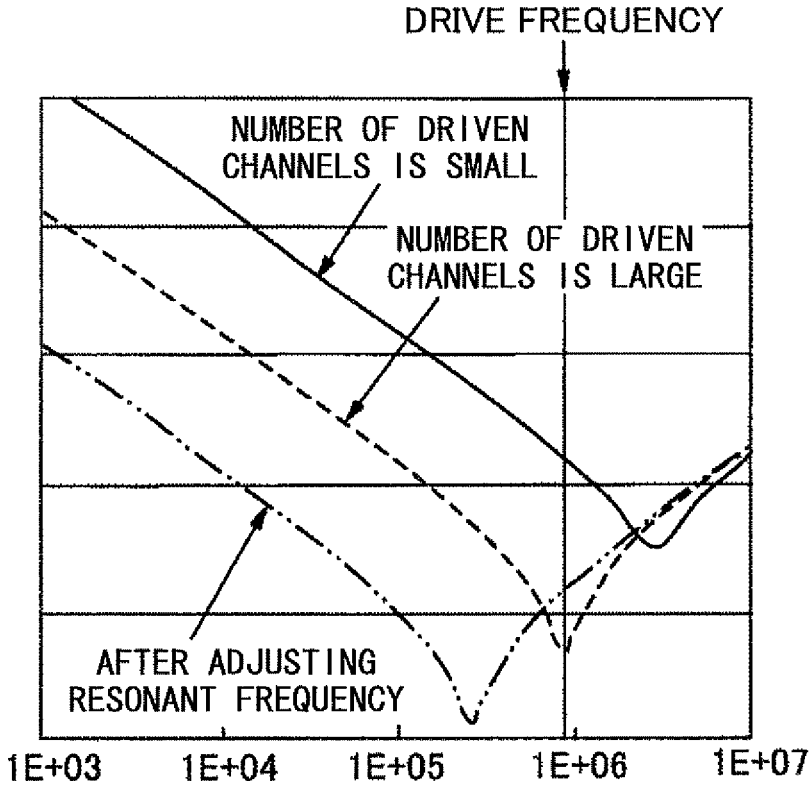
FIG. 9 is a diagram illustrating an effect of the first embodiment.

Namely, as shown in FIG. 9, when the switch 722 is turned off, the resonant frequency of the closed loop, when the number of simultaneously driven channels is small, is higher than a frequency of the drive waveform (drive frequency), as shown by the solid line. However, as the number of the driven channels increases, the resonant frequency of the closed loop decreases as shown by the dotted line, and it is possible that the resonant frequency of the closed loop coincides with the drive frequency. If the resonant frequency coincides with the drive frequency, peaking occurs such that gain of the drive waveform becomes extremely large. Thus discharging instability, such as density unevenness, occurs.

Therefore, the number of the simultaneously driven channels, when the resonant frequency coincides with the drive frequency or when the resonant frequency becomes close to the drive frequency, is defined to be the predetermined number m. When the number of simultaneously driven channels becomes greater than or equal to the predetermined number m, the resonant frequency is decreased to a position shown by the double-dotted line in FIG. 9 by turning the switch 722 on and connecting the resonant frequency adjusting circuit 721. In this manner, the resonant frequency is prevented from coinciding with the drive frequency, and the peaking (such that the gain of the drive frequency becomes extremely large) can be prevented. Therefore, variation of the droplet discharging characteristic of the liquid discharge head is reduced.

The liquid discharge head includes the resonant frequency adjusting circuit 721, which is connected in parallel with the plural piezoelectric elements C, and which includes at least one of the inductance component or the capacitance component; the switch 722 that switches between connection and disconnection of the resonant frequency adjusting circuit 721; and the switching control unit 723 that controls and switches the switch 722 in accordance with the number of simultaneously driven piezoelectric elements. When the number of the simultaneously driven piezoelectric elements C is greater than or equal to the predetermined number m, the switching control unit 723 turns on the switch 722 so that the resonant frequency adjusting circuit 721 is connected. Thus, when the number of the simultaneously driven piezoelectric elements C is greater than or equal to the predetermined number m, the plural piezoelectric elements C are connected in parallel with at least one of the inductance component and the capacitance component. In this manner, when the number of the simultaneously driven piezoelectric elements C is greater than or equal to the predetermined number m, the resonant frequency of the closed loop, which starts from the drive waveform generating unit 701 and ends at the drive waveform generating unit 701 through the liquid discharge head, is lowered compared to the resonant frequency of the closed loop when the number of the simultaneously driven piezoelectric elements C is less than the predetermined number m. With such a configuration, the variation of the drive waveform caused by the variation in the number of simultaneously driven piezoelectric elements is reduced, and the variation of the liquid discharging characteristic is reduced. Thus the image quality can be Improved.

Further, in the above configuration such that the resonant frequency of the closed loop is lowered when the number of the simultaneously driven channels is greater than or equal to the predetermined number m, the resonant frequency adjusting circuit 721 is connected to the simultaneously driven piezoelectric elements C only when it is required to connect the resonant frequency adjusting circuit 721. Therefore, generation of heat and electric power consumption is reduced compared to a case in which the resonant frequency adjusting circuit 721 is usually connected, and the resonant frequency adjusting circuit 721 is disconnected only when the number of the simultaneously driven channels is greater than or equal to the predetermined number m.

Figure 10:
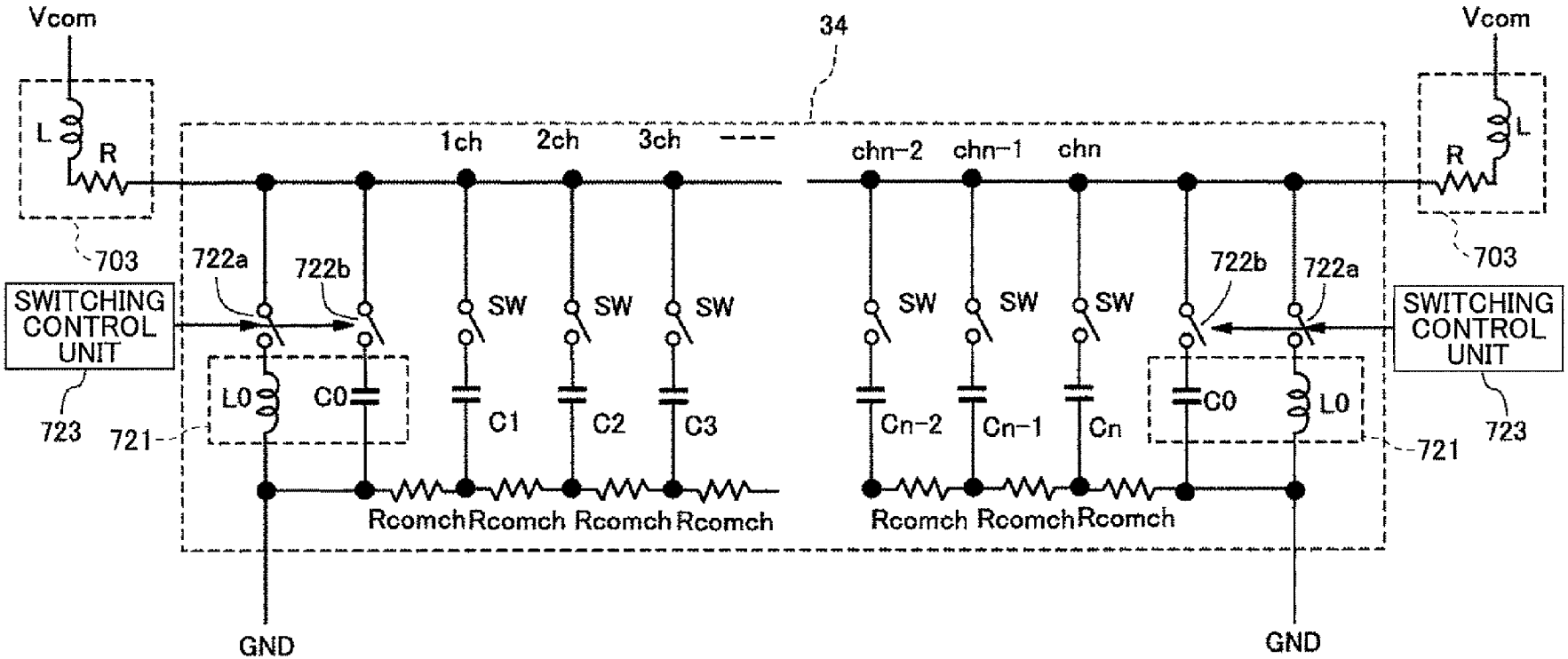
FIG. 10 is a diagram illustrating a circuit according to a second embodiment.

Hereinafter, a second embodiment of the present invention is explained by referring to FIG. 10. FIG. 10 is a diagram for illustrating a circuit according to the second embodiment. The resonant frequency adjusting circuit 721 includes a parallel circuit in which an inductance component L0 and a capacitance component C0 are connected. The inductance component L0 is connected in series with a switch (analog switch) 722*a*. The capacitance component C0 is connected in series with a switch (analog switch) 722*b*.

The switches 722*a* and 722*b* are turned on or turned off by an on/off signal (data) from the switching control unit 723 at the side of the print control unit 508. When the number of the simultaneously driven channels is less than the predetermined number m, the switching control unit 723 turns off the switches 722*a* and 722*b*. When the number of the simultaneously driven channels is greater than or equal to the predetermined number m, the switching control unit 723 turns on the switches 722*a* and 722*b*.

With the above configuration, similar to the first embodiment, when the number of the simultaneously driven channels is greater than or equal to the predetermined number m, the parallel circuit formed of the inductance component L0 and the capacitance component C0 included in the resonant frequency adjusting circuit 721 is connected in parallel with the plural piezoelectric elements C. In this manner, the resonant frequency of the closed loop circuit is lowered compared to the resonant frequency of the closed loop circuit when the resonant frequency adjusting circuit 721 is disconnected from the closed loop circuit. Thus, the resonant frequency of the closed loop circuit is prevented from coinciding with the drive frequency.

Therefore, similar to the first embodiment described above, the variation of the drive frequency caused by the variation in the number of simultaneously driven piezoelectric elements C is reduced, and the variation of the liquid discharging characteristic is reduced. Thus the image quality can be improved.

Figure 11:
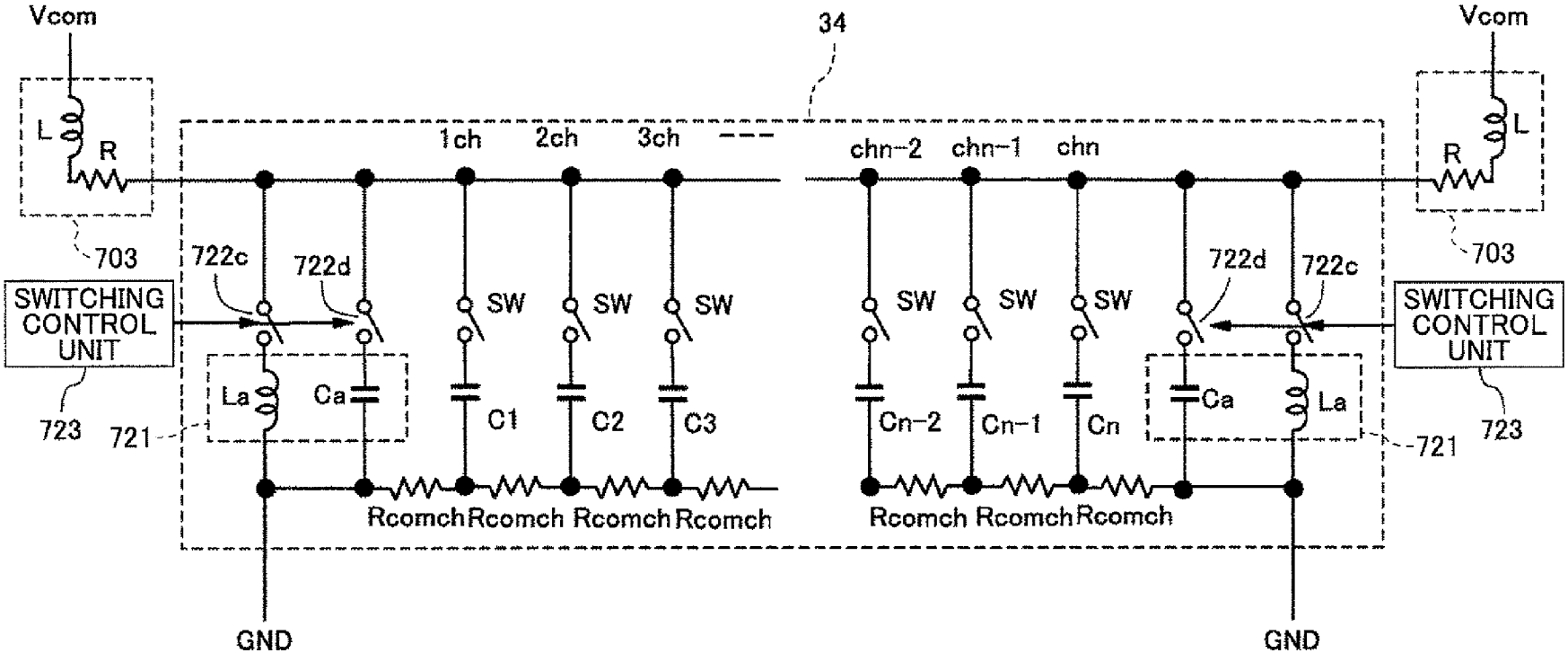
FIG. 11 is a diagram illustrating a circuit according to a third embodiment.

Hereinafter, a third embodiment of the present invention is explained by referring to FIG. 11. Here, FIG. 11 is a diagram illustrating a circuit according to the third embodiment. In the third embodiment, switches 722*c* and 722*d*, which are usually turned on, are used, instead of the switches 722*a* and 722*b* in the second embodiment, which are usually turned off. The switching control unit 723 leaves the switches 722*c* and 722*d* turned on when the number of the simultaneously driven channels is less than the predetermined number m. The switching control unit 723 turns off the switches 722*c* and 722*d* when the number of the simultaneously driven channels is greater than or equal to the predetermined number m. Here, the inductance component and the capacitance component of the resonant frequency adjusting circuit 721 are La and Ca, respectively. The inductance component La and the capacitance component Ca are set to values such that, when the resonant frequency adjusting circuit 721 is connected and the number of the simultaneously driven channels is less than the predetermined number m, the resonant frequency and the drive frequency of the drive waveform do not coincide with each other.

In the above configuration, when the number of simultaneously driven channels is less than the predetermined number m, the parallel circuit formed of the inductance component L0 and the capacitance component C0 included in the resonant frequency adjusting circuit 721 is connected in parallel with the plural piezoelectric elements C. When the number of the simultaneously driven channels increases and the resonant frequency is lowered, namely, when the number of simultaneously driven channels becomes greater than or equal to the predetermined number m, the resonant frequency adjusting circuit 721 is disconnected from the plural piezoelectric elements C. In this manner, the resonant frequency becomes higher (returns to the original resonant frequency), and the resonant frequency in the closed loop is prevented from coinciding with the drive frequency.

Therefore, similar to the first embodiment described above, the variation of the drive frequency caused by the variation in the number of simultaneously driven piezoelectric elements C is reduced, and the variation of the liquid discharging characteristic is reduced. Thus the image quality can be improved.

Figure 12:
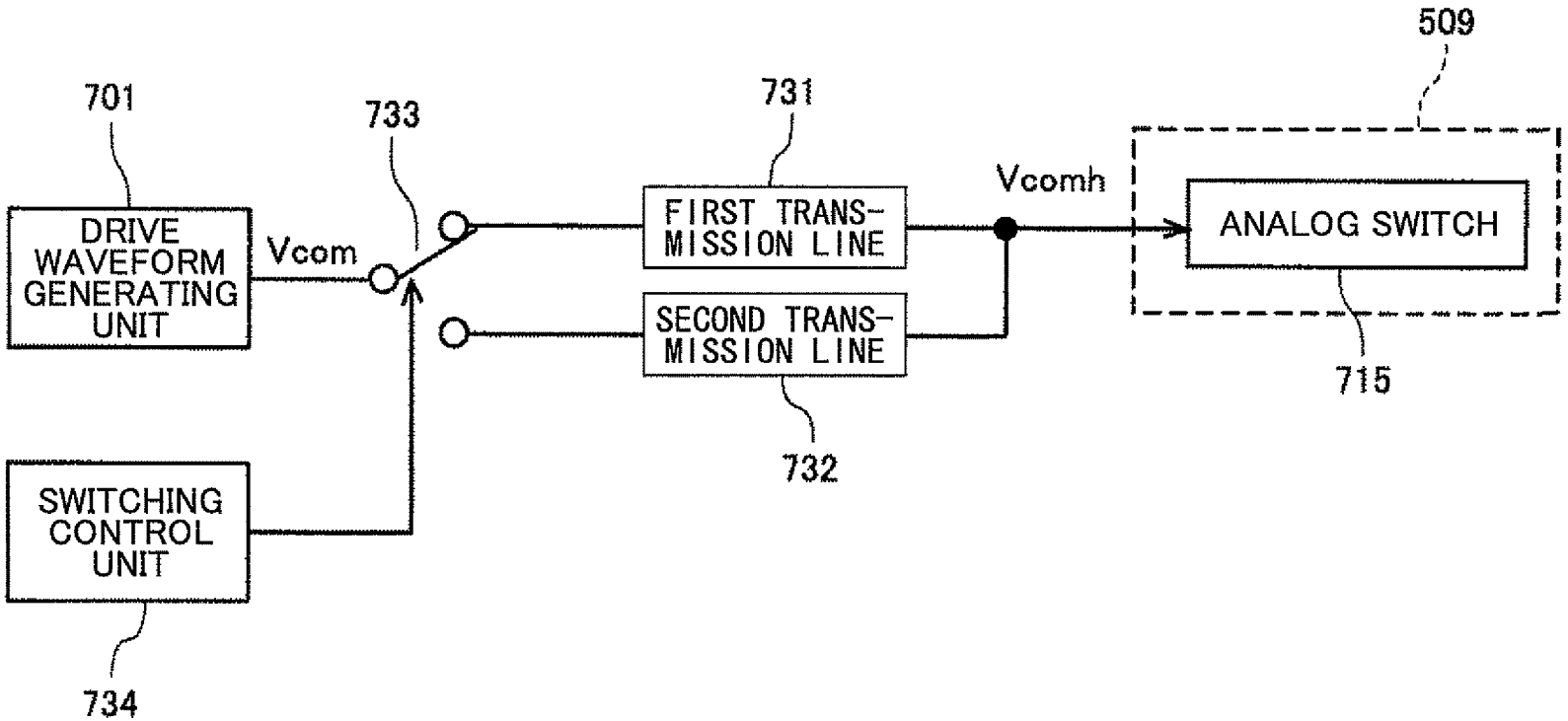
FIG. 12 is a block diagram illustrating a configuration according to a fourth embodiment.

Hereinafter, a fourth embodiment of the present invention is explained by referring to FIG. 12. Here, FIG. 12 is a block diagram illustrating a configuration of the liquid discharge head according to the fourth embodiment. In the fourth embodiment, the liquid discharge head includes a first transmission line 731 and a second transmission line 732 connected in parallel as transmission lines from the drive waveform generating unit 701 to the head driver 509; and a switch 733 for switching between the first transmission line 731 and the second transmission line 732. An impedance component of the first transmission line 731 is set to be smaller than an impedance component of the second transmission line 732.

The switch 733 is controlled by a switching signal (data) from a switching control unit 734 at the side of the print control unit 508. When the number of the simultaneously driven piezoelectric elements C is less than the predetermined number m, the switching control unit 734 causes the switch 733 to turn on the second transmission line 732. On the other hand, when the number of the simultaneously driven piezoelectric elements C is greater than or equal to the predetermined number m, the switching control unit 734 causes the switch 733 to turn on the first transmission line 731.

In the above described configuration, similar to the first embodiment, the switching control unit 734 calculates the number of simultaneously driven piezoelectric elements C (the number of the simultaneously driven channels), which are driven in a same drive period, from the image data, and the switching control unit 734 determines whether the number of the simultaneously driven channels is greater than or equal to the predetermined number m.

When the switching control unit 734 determines that the number of the simultaneously driven channels is less than the predetermined number m, the switching control unit 734 outputs a signal which causes the switch 733 to turn on the second transmission line 732. With this, in the drive period, a drive waveform Vcom from the drive waveform generating unit 701 is input to the head driver 509 as a drive waveform Vcomh through the second transmission line 732, and the drive waveform Vcomh is applied to the piezoelectric elements C through the analog switches 715.

Further, when the switching control unit 734 determines that the number of the simultaneously driven channels is greater than or equal to the predetermined number m, the switching control unit 734 outputs a signal which causes the switch 733 to turn on the first transmission line 731. In the drive period, a drive waveform Vcom from the drive waveform generating unit 701 is input to the head driver 509 as a drive waveform Vcomh through the first transmission line 731, and the drive waveform Vcomh is applied to the piezoelectric elements C through the analog switches 715.

Therefore, when the number of the simultaneously driven channels is less than the predetermined number m, the drive waveform is transmitted through the second transmission line 732 including the high impedance component. However, when the number of the simultaneously driven channels becomes greater than or equal to the predetermined number m and the resonant frequency is lowered, the drive waveform is transmitted through the first transmission line 731 including the lower impedance component. Thus the resonant frequency becomes higher, and the resonant frequency is prevented from coinciding with the drive frequency of the drive waveform. Using the example of FIG. 9, when the resonant frequency indicated by the solid line is lowered by the increase of the number of the simultaneously driven channels, the second transmission line 732 is switched to the first transmission line 731, prior to the resonant frequency coinciding with the drive frequency. Then the resonant frequency moves toward the resonant frequency indicated by the solid line, and the resonant frequency is prevented from coinciding with the drive frequency.

Figure 13:
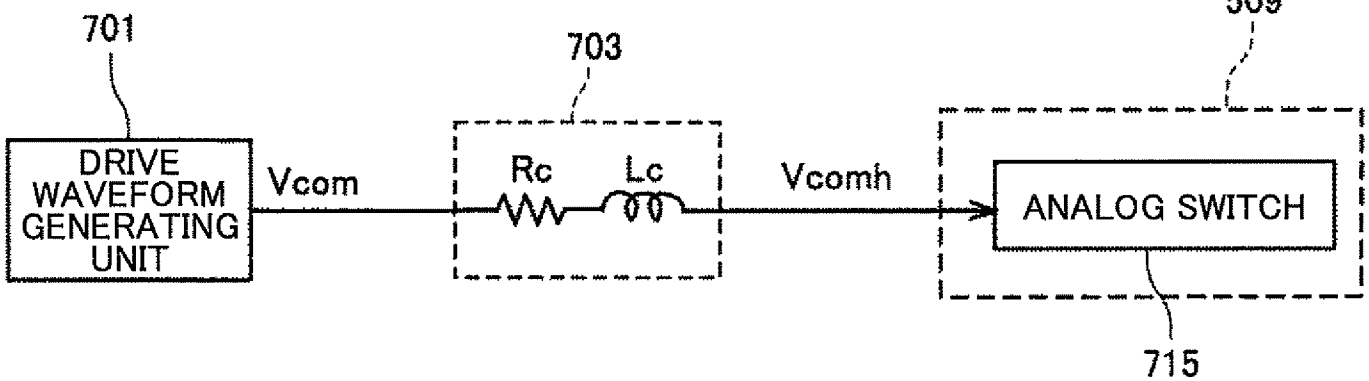
FIG. 13 is a block diagram illustrating a comparative example.

Hereinafter, a comparative example is explained by referring to FIGS. 13 through 15. As shown in FIG. 13, in the comparative example, a drive waveform Vcom from the drive waveform generating unit 701 is input to the analog switches 715 in the head driver 509 through the FFC 703 having a resistance component R and an inductance component L. Namely, there is only one transmission line from the drive waveform generating unit 701 to the head driver 509.

Figures 14A, 14B, 14C:
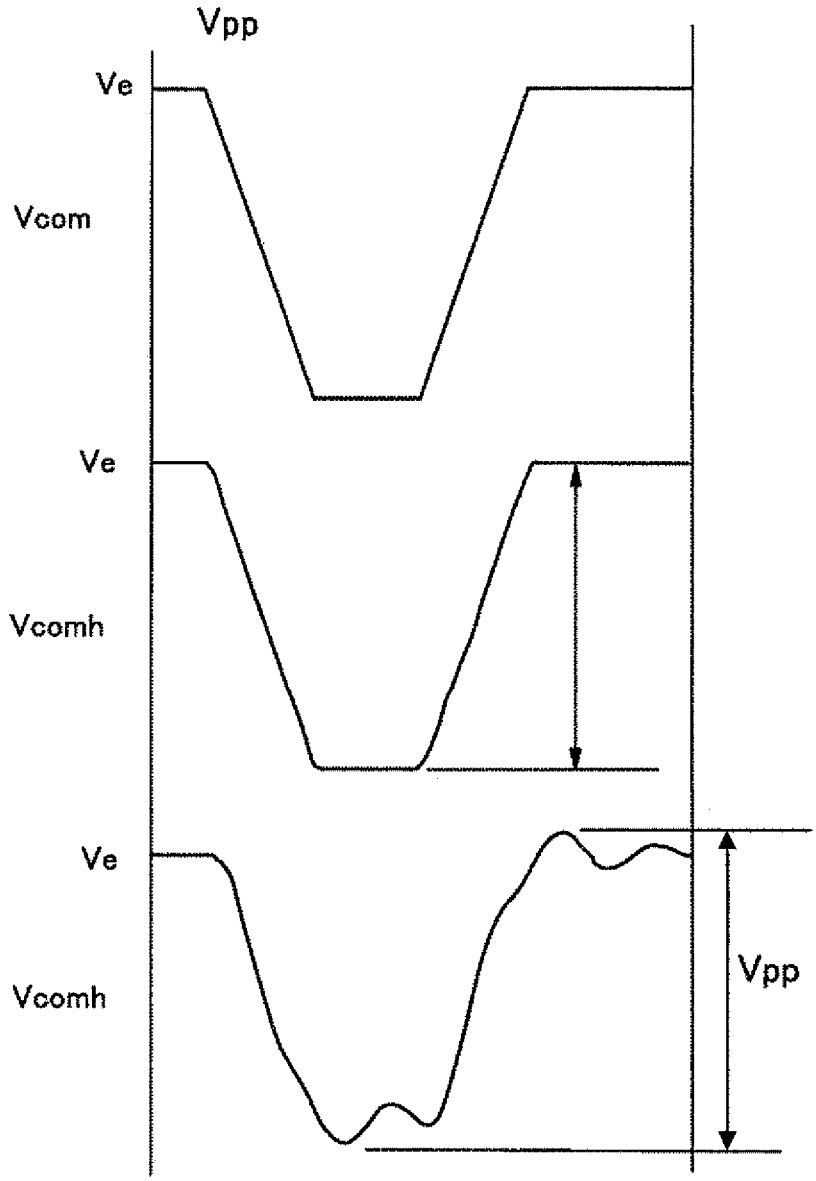
FIG. 14A is a diagram illustrating an input waveform in the comparative example.
FIG. 14C is a diagram illustrating an output waveform when all the channels are simultaneously driven in the comparative example.

In the comparative example, when the drive waveform generating unit 701 generates and outputs the drive waveform (output drive waveform) Vcom indicated in FIG. 14A, and when only one of the piezoelectric elements C is simultaneously driven, the drive waveform (input drive waveform) Vcomh has the waveform which is substantially equivalent to the waveform of the output drive waveform Vcom, as indicated in FIG. 14B. On the other hand, when all the piezoelectric elements C are simultaneously driven, in the input drive waveform Vcomh, which is input to each of the piezoelectric elements C, the peaking occurs because of the effect of the resonant frequency, as shown in FIG. 14C.

Figure 15:
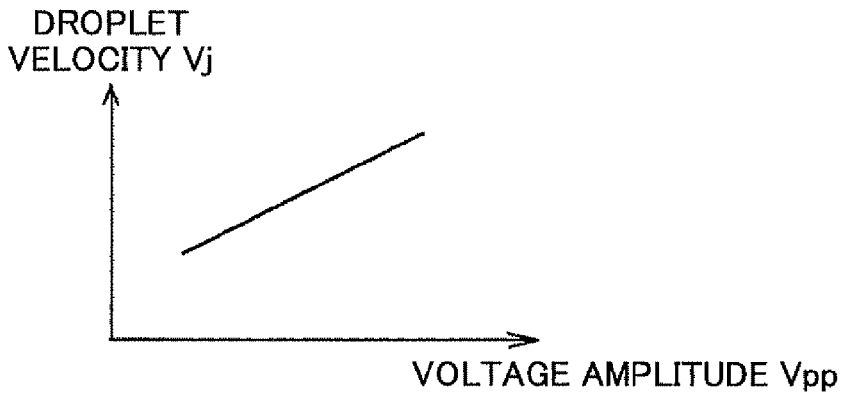
FIG. 15 is a diagram illustrating a relationship between a voltage amplitude Vpp of a drive waveform and a droplet velocity Vj.

FIG. 15 indicates a relation between a peak value Vpp of the input drive waveform Vcomh and a droplet velocity Vj. As the peak value Vpp increases, the droplet velocity Vj increases. Since a droplet volume Mj is in proportion to the droplet velocity Vj, the droplet volume Mj increases accordingly.

Figure 16:
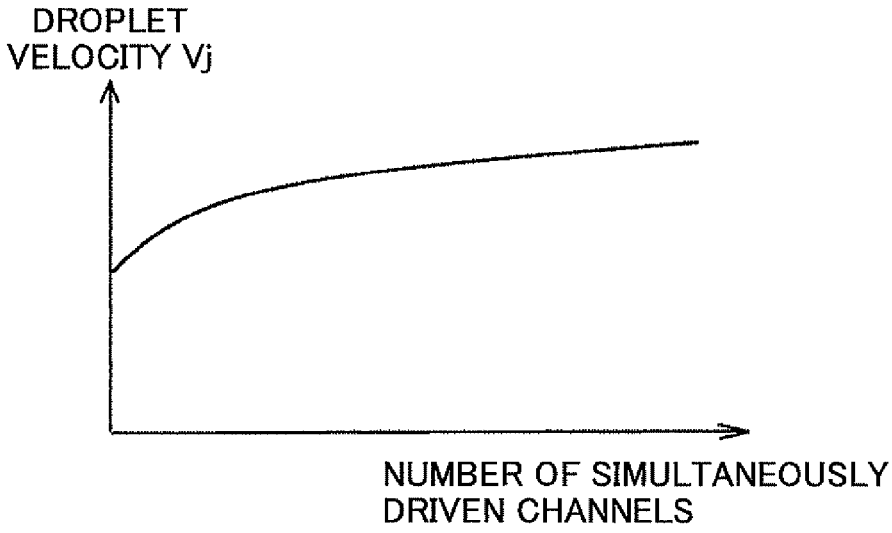
FIG. 16 is a diagram illustrating a relationship between number of simultaneously driven channels and the droplet velocity Vj in the comparative example.

Consequently, as shown in FIG. 16, since the peak value Vpp becomes greater as the number of the simultaneously driven channels is increased, the droplet velocity Vj increases when the number of the simultaneously driven channels is increased. Such variation in the droplet discharging characteristic results in shifts of positions, where droplets adhere on a sheet, and density unevenness. Thus, such variation in the droplet discharging characteristic lowers quality of an image.

Therefore, as described above, the resonant frequency can be prevented from coinciding with the drive frequency by shifting the resonant frequency by switching between transmission lines having different impedance components, depending on the number of the simultaneously driven channels. In this manner, the shifts of the positions, at which the droplets adhere on the sheet, and the density unevenness caused by the variation in the droplet discharging characteristic can be reduced, and the quality of the image can be prevented from lowering.

The recording head 34 according to the fourth embodiment includes the first transmission line 731 and the second transmission line 732 for transmitting the drive waveform from the drive waveform generating unit 701 to the piezoelectric elements C; the switch 733 for switching between the first transmission line 731 and the second transmission line 732; and the switching control unit 734 that causes the switch 733 to switch in accordance with the number of the simultaneously driven piezoelectric elements C. Here, the impedance component of the first transmission line 731 is less than the impedance component of the second transmission line 732. When the number of the simultaneously driven piezoelectric elements C is less than the predetermined number m, the switching control unit 734 causes the switch 733 to turn on the second transmission line 732. Further, when the number of the simultaneously driven piezoelectric element C is greater than or equal to the predetermined number m, the switching control unit 734 causes the switch 733 to turn on the first transmission line 731. In this manner, the variation of the drive waveform caused by the variation in the number of the simultaneously driven piezoelectric elements is reduced, and the variation of the droplet discharging characteristic is reduced. Therefore, the image quality can be improved.

Figure 17:
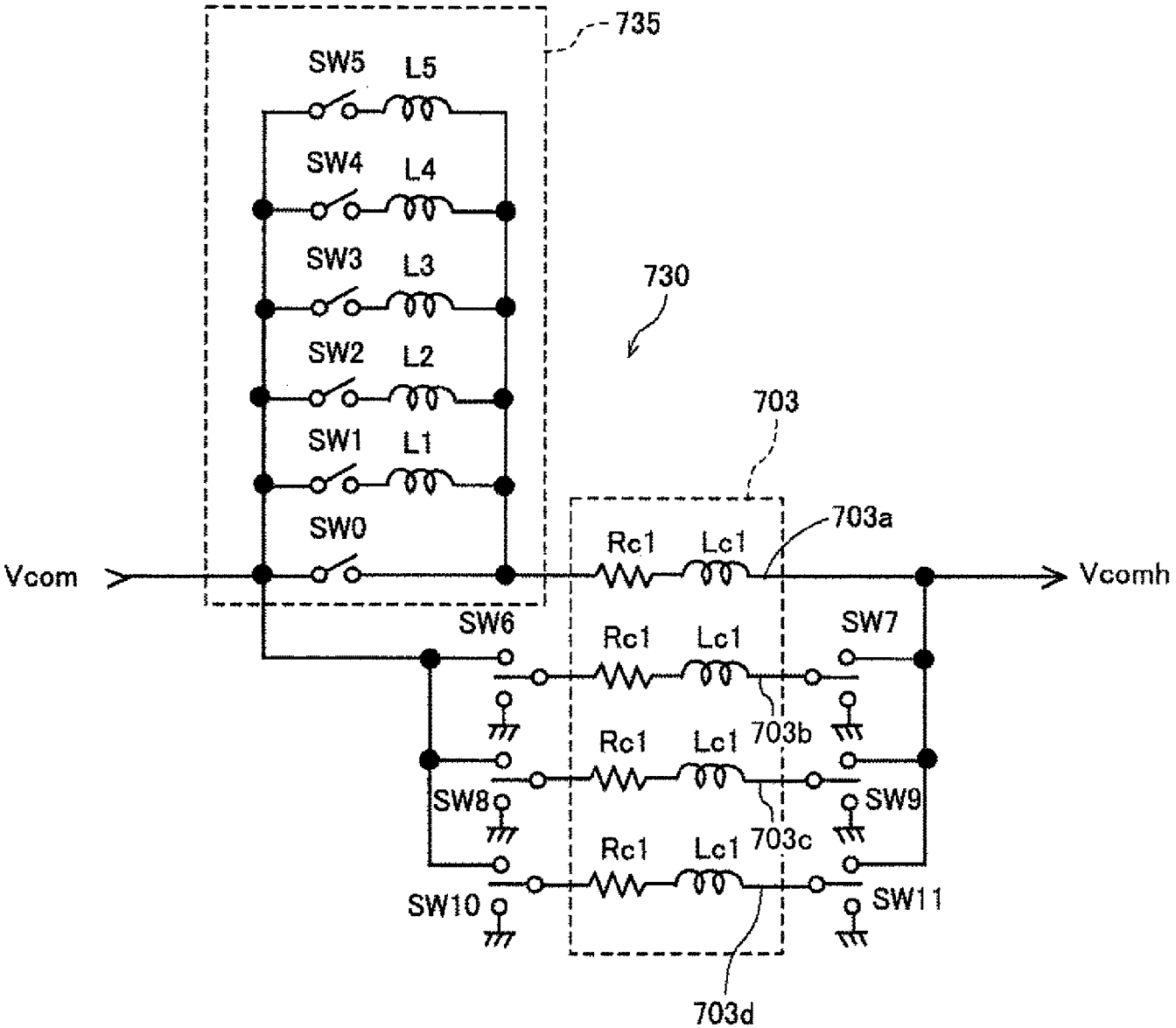
FIG. 17 is a diagram illustrating a circuit of a transmission line portion in a fifth embodiment.

Hereinafter, a fifth embodiment of the present invention is explained by referring to FIG. 17. FIG. 17 is a diagram illustrating a circuit of a transmission line portion (transmission line from the drive waveform generating unit 701 to the head driver 509) in the fifth embodiment. The input drive waveform Vcom from the drive waveform generating unit 701 is transmitted through a transmission line 730 having four signal lines 703*a*-703*d* and is input to the piezoelectric elements C as the output drive waveform Vcomh through the analog switches 715 of the head driver 509. Here, each of the signal lines 703*a*-703*d* of the FFC 703 includes a resistance component Rc1 and an inductance component Lc1.

A circuit 735 is arranged in front of the signal line 703*a* of the FFC 703. Here, the circuit 735 is a circuit for varying an inductance component in accordance with the number of the simultaneously driven channels. In the circuit 735, a switch SW0 and series circuits including a switch SW1 and a coil L1, a switch SW2 and a coil L2, a switch SW3 and a coil L3, a switch SW4 and a coil L4, and a switch SW5 and a coil L5, respectively, are connected in parallel. Further, each of the switches SW0 through SW5 is a bipolar switch for connection and disconnection, and utilizes a semiconductor element, such as an analog switch.

Further, the signal line 703*b* of the FFC 703 can be connected to and disconnected from the transmission line 730 by switches SW6 and SW7. The signal line 703*c* of the FFC 703 can be connected to and disconnected from the transmission line 730 by switches SW8 and SW9. The signal line 703*d* of the FFC 703 can be connected to and disconnected from the transmission line 730 by switches SW10 and SW11. Each of the switches SW6-SW11 is a three-pole switch such that it can be switched to an input and output side for inputting and outputting the drive waveforms (Vcom, Vcomh), or it can be grounded. For each of the switches SW6-SW11, two analog switches are utilized, and the two analog switches are exclusively operated.

Here, the resistance component Rc1 and the inductance component Lc1 of the FFC 703 are, for example, Rc1=0.025Ω, and Lc1=1.2 μH. The inductance components of the coils L1 through L5 are, for example, L1=46.8 μH, L2=18 μH, L3=9.5 μH, L4=3.6 μH, and L5=1.2 μH.

The effect of the fifth embodiment configured as described above is explained by referring to FIG. 18. FIG. 18 shows states of the switches SW0-SW11, which are corresponding to the number of the simultaneously driven channels. In FIG. 18, for the switches SW0-SW5, "○" means that the switch is turned on, and "x" means that the switch is turned off. Further, for the switches SW6-SW11, "○" means that the switch is connected to the side of the drive waveform, and "x" means that the switch is connected to the ground. As described above, these switches SW0-SW11 are controlled by the print control unit 508.

In FIG. 18, when the number of the simultaneously driven channels is from 1 to 40, one of the switches SW1-SW5 is turned on, and the drive waveform Vcom is transmitted through one of the signal lines included in the FFC 703. At that time, the switches SW6-SW11 are always connected to the ground, and the impedance of the transmission line 730 becomes low. When the number of the simultaneously driven channels becomes greater than or equal to 41, only the switch SW0 is turned on among the switches SW0-SW5, and a state of the transmission line 730 is selected by controlling the switches. SW6-SW11.

Figure 19:
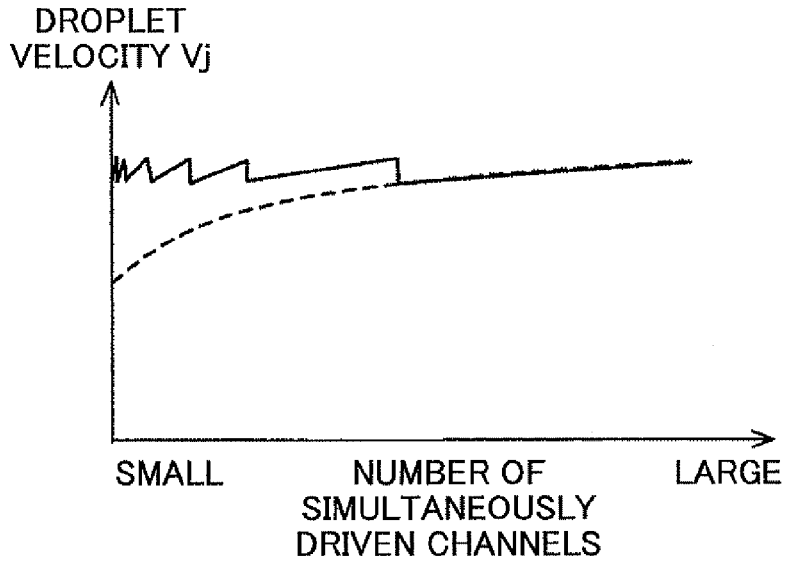
FIG. 19 is a diagram illustrating a relationship between the number of simultaneously driven channels and the droplet velocity Vj in the fifth embodiment.

The solid line in FIG. 19 indicates a relationship between the number of the simultaneously driven channels and the droplet velocity when the switching operation shown in FIG. 18 is performed. Here, the dotted line in FIG. 19 indicates conventional variation of the droplet discharging characteristic. The conventional droplet discharging operation is such that the liquid discharge head discharges when the number of the simultaneously driven channels is from 1 to 160, and a state of the transmission line 730 is the state of the transmission line, which is selected when the number of the simultaneously driven channels is from 161 to 320 in FIG. 18. It can be understood from FIG. 19 that, in the fifth embodiment, the variation of the droplet discharging characteristic is regulated. This is attributable that the state of the transmission line 730 is selected so that the resonant frequency of the circuit, which includes the piezoelectric elements as electrical loads, coincides with the drive frequency of the drive waveform.

Figure 20:
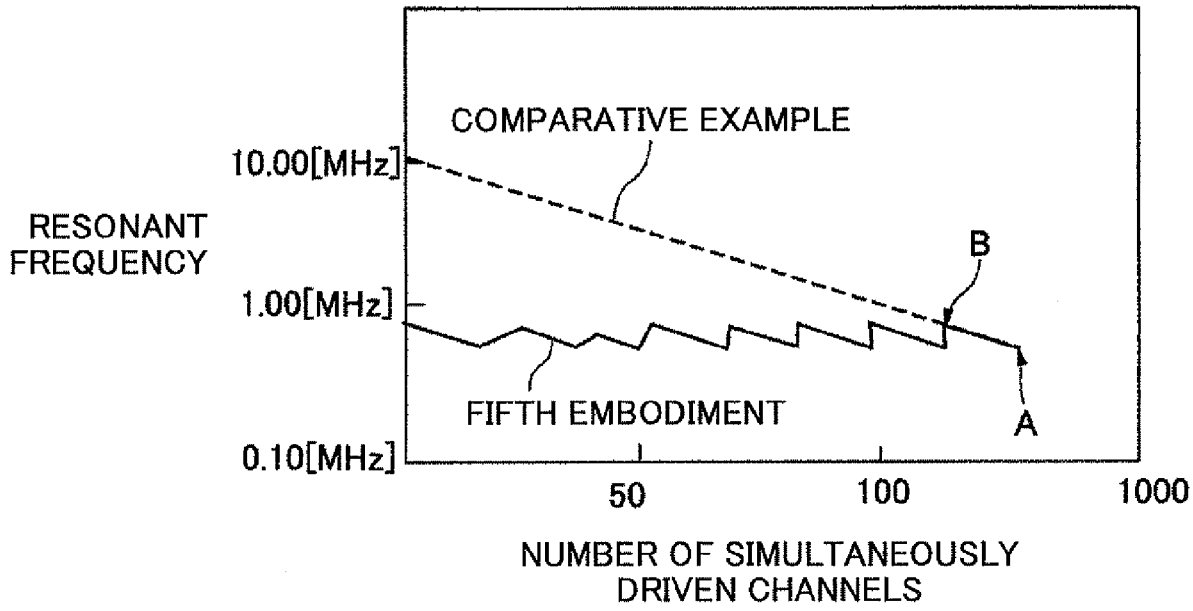
FIG. 20 is a diagram illustrating a relationship between the number of simultaneously driven channels and a resonant frequency in the fifth embodiment.

Further, FIG. 20 shows a relationship between the number of the simultaneously driven channels and the resonant frequency. It can be seen in FIG. 20 that, in the conventional case, the resonant frequency varies within a range from 570 kHz to 10.3 MHz. However, with the configuration according to the fifth embodiment, the variation of the resonant frequency is regulated within a range from 570 kHz to 810 kHz, because of the selection of the states of the transmission line 730.

Figures 21A, 21B:
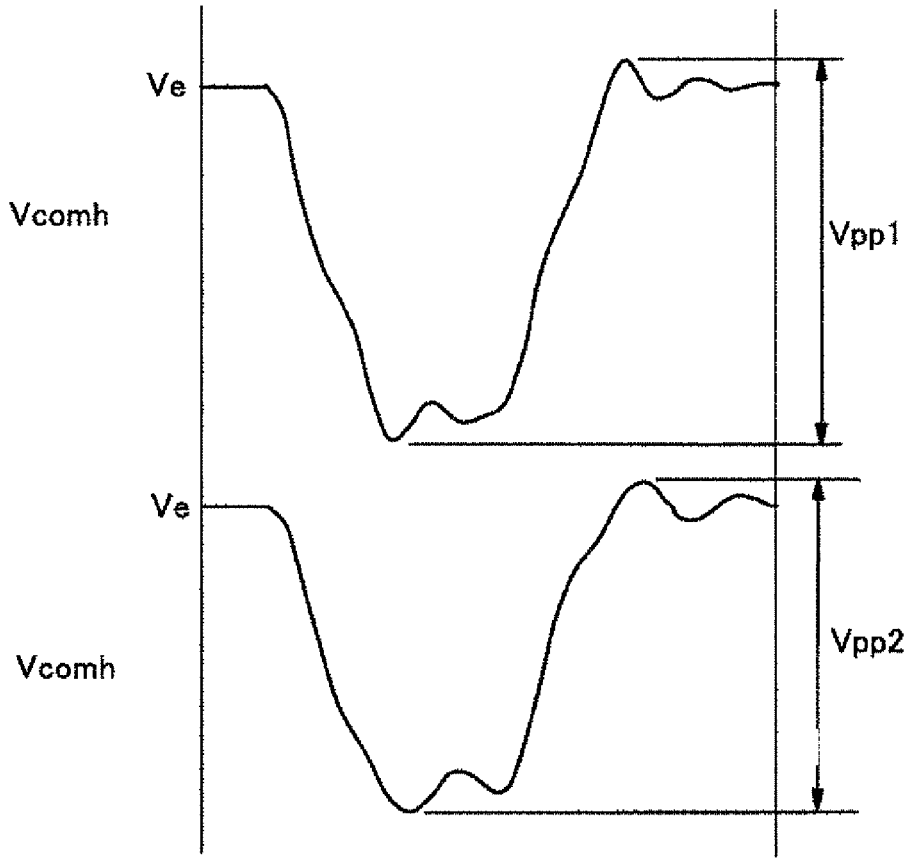
FIGS. 21A and 21B are diagrams for illustrating a relationship among the number of the simultaneously driven channels, an output drive waveform, and input drive waveform in the fifth embodiment.

FIGS. 21A and 21B show response waveforms in such a system. FIG. 21A indicates an input drive waveform Vcomh, which is input to the piezoelectric elements C in the state indicated by the point A in FIG. 20, with respect to an output drive waveform Vcom output from the drive waveform generating unit 701 in FIG. 14A. FIG. 21B is an input drive waveform Vcomh, which is input to the piezoelectric elements C in the state indicated by the point B in FIG. 20. As shown in FIGS. 21A and 21B, the state where the peaking occurs in the output drive waveform Vcom is maintained, and the variation of the peak value Vpp of the drive waveform Vcomh is reduced. Further, as the peak value Vpp of the input drive waveform Vcomh, which is input to the piezoelectric element C, an output value greater than the peak value of the output drive waveform Vcom, which is output from the drive waveform generating unit 701, is obtained.

In the above embodiments, the image forming device is exemplified as the image forming device of a serial type. However, the embodiment is not limited to this. The embodiments may also be implemented in a line-type image forming device.

The present invention is not limited to the specifically disclosed embodiments, and variations and modifications may be made without departing from the scope of the present invention.

The present application is based on Japanese Priority Application No. 2011-050684, filed on Mar. 8, 2011, the entire contents of which are hereby incorporated herein by reference.

What is claimed is:

1. An image forming device comprising:

a liquid discharge head including plural piezoelectric elements for generating pressure for discharging liquid droplets;

a drive waveform generating unit configured to generate and output a drive waveform for driving plural of the piezoelectric elements;

a selection unit configured to selectively apply the drive waveform from the drive waveform generating unit to plural of the piezoelectric elements in accordance with a print image;

a resonant frequency adjusting circuit including at least one of an inductance component and a capacitance component, the resonant frequency adjusting circuit being disconnectably connected in parallel with plural of the piezoelectric elements;

a switch unit configured to switch between connection and disconnection of the resonant frequency adjusting circuit; and a switching control unit configured to cause the switch unit to switch in accordance with a first number of simultaneously driven piezoelectric elements among plural of the piezoelectric elements, wherein, when the first number of the simultaneously driven piezoelectric elements is greater than or equal to a predetermined number, the switching control unit causes the switch unit to switch to a state where the resonant frequency adjusting circuit is connected, so that plural of the piezoelectric elements are connected in parallel with the at least one of the inductance component and the capacitance component, and so that a resonant frequency of a closed loop that starts from the drive waveform generating unit and ends at the drive waveform generating unit through the liquid discharge head becomes lower than a resonant frequency of the closed loop when the first number of the simultaneously driven piezoelectric elements is less than the predetermined number.

2. The image forming device according to claim 1, wherein the switching control unit is configured to calculate the first number of the simultaneously driven piezoelectric elements from image data.

3. An image forming device comprising:

a liquid discharge head including plural piezoelectric elements for generating pressure for discharging liquid droplets;

a drive waveform generating unit configured to generate and output a drive waveform for driving plural of the piezoelectric elements;

a selection unit configured to selectively apply the drive waveform from the drive waveform generating unit to plural of the piezoelectric elements in accordance with a print image;

a resonant frequency adjusting circuit including at least one of an inductance component and a capacitance component, the resonant frequency adjusting circuit being disconnectably connected in parallel with plural of the piezoelectric elements;

a switch unit configured to switch between connection and disconnection of the resonant frequency adjusting circuit; and a switching control unit configured to cause the switch unit to switch in accordance with a first number of simultaneously driven piezoelectric elements among plural of the piezoelectric elements, wherein, when the first number of the simultaneously driven piezoelectric elements is greater than or equal to a predetermined number, the switching control unit causes the switch unit to switch to a state where the resonant frequency adjusting circuit is disconnected, so that plural of the piezoelectric elements are disconnected from the at least one of the inductance component and the capacitance component connected in parallel with plural of the piezoelectric elements, and so that a resonant frequency of a closed loop that starts from the drive waveform generating unit and ends at the drive waveform generating unit through the liquid discharge head becomes higher than a resonant frequency of the closed loop when the first number of the simultaneously driven piezoelectric elements is less than the predetermined number.

* * * * *